US010655647B2

(12) United States Patent
Takebayashi et al.

(10) Patent No.: US 10,655,647 B2
(45) Date of Patent: May 19, 2020

(54) HYDRAULIC DRIVE SYSTEM FOR CONSTRUCTION MACHINE

(71) Applicant: HITACHI CONSTRUCTION MACHINERY TIERRA CO., LTD., Shiga (JP)

(72) Inventors: Yoshifumi Takebayashi, Koka (JP); Kiwamu Takahashi, Koka (JP); Kazushige Mori, Koka (JP); Natsuki Nakamura, Koka (JP)

(73) Assignee: HITACHI CONSTRUCTION MACHINERY TIERRA CO., LTD., Shiga (JP)

( * ) Notice: Subject to any disclaimer, the term of this patent is extended or adjusted under 35 U.S.C. 154(b) by 297 days.

(21) Appl. No.: 15/883,357

(22) Filed: Jan. 30, 2018

(65) Prior Publication Data

US 2018/0156242 A1 Jun. 7, 2018

Related U.S. Application Data

(63) Continuation of application No. 14/383,150, filed as application No. PCT/JP2013/059946 on Apr. 1, 2013, now abandoned.

(30) Foreign Application Priority Data

Apr. 10, 2012 (JP) ..... 2012-089670

(51) Int. Cl.
*F15B 9/08* (2006.01)
*E02F 3/32* (2006.01)
(Continued)

(52) U.S. Cl.
CPC ..... *F15B 9/08* (2013.01); *E02F 3/325* (2013.01); *E02F 9/2203* (2013.01);
(Continued)

(58) Field of Classification Search
CPC ..... E02F 9/2203; E02F 9/2225; E02F 9/2285; E02F 9/2296; F15B 9/08; F15B 9/03; F15B 11/166; F15B 13/06
(Continued)

(56) References Cited

U.S. PATENT DOCUMENTS 4,508,013 A 4/1985 Barbagli
6,397,591 B1 * 6/2002 Tsuruga ..... E02F 3/325 60/422
(Continued)

FOREIGN PATENT DOCUMENTS

JP 04-370402 A 12/1992
JP 07-076861 A 3/1995
(Continued)

OTHER PUBLICATIONS

International Preliminary Report on Patentability received in International Application No. PCT/JP2013/059946 dated Oct. 3, 2014.

*Primary Examiner* — Nathaniel E Wiehe
*Assistant Examiner* — Richard C Drake
(74) *Attorney, Agent, or Firm* — Mattingly & Malur, PC

(57) ABSTRACT

Pressure compensating valves not fully closing at the stroke end are employed, and upon the operator's operation for the traveling, pilot primary pressure is reduced and supplied to remote control valves 34*c*-34*h* of non-travel operating devices. Thus, the inflow of the hydraulic fluid into non-travel actuators is suppressed and a necessary amount of hydraulic fluid for travel motors is secured in travel combined operation. Accordingly, when saturation occurs in a construction machine's hydraulic drive system performing the load sensing control due to combined operation with a great load pressure difference between two actuators, deceleration/stoppage of an actuator on the low load pressure side is prevented by preventing full closure of the pressure compensating valve on the low load pressure side, while also
(Continued)

preventing deceleration/stoppage of a high load pressure actuator by securing a necessary amount of hydraulic fluid for the high load pressure actuator.

7 Claims, 10 Drawing Sheets

(51) Int. Cl.

| | |
|---|---|
| ***E02F 9/22*** | (2006.01) |
| ***F15B 11/16*** | (2006.01) |
| ***F15B 13/06*** | (2006.01) |
| ***F15B 9/03*** | (2006.01) |

(52) U.S. Cl.
CPC ..... *E02F 9/2225* (2013.01); *E02F 9/2285* (2013.01); *E02F 9/2296* (2013.01); *F15B 9/03* (2013.01); *F15B 11/166* (2013.01); *F15B 13/06* (2013.01); *F15B 2211/20553* (2013.01); *F15B 2211/30535* (2013.01); *F15B 2211/329* (2013.01); *F15B 2211/355* (2013.01); *F15B 2211/6051* (2013.01); *F15B 2211/6055* (2013.01); *F15B 2211/6058* (2013.01); *F15B 2211/6355* (2013.01); *F15B 2211/7058* (2013.01); *F15B 2211/7135* (2013.01); *F15B 2211/781* (2013.01)

(58) Field of Classification Search
USPC ..... 60/420
See application file for complete search history.

(56) References Cited

U.S. PATENT DOCUMENTS

| | | | | |
|---|---|---|---|---|
| 6,408,622 | B1 * | 6/2002 | Tsuruga | E02F 9/2207 60/422 |
| 8,857,169 | B2 * | 10/2014 | Takahashi | E02F 9/2225 60/422 |
| 8,919,109 | B2 * | 12/2014 | Takahashi | E02F 9/2235 60/295 |
| 9,080,481 | B2 * | 7/2015 | Takebayashi | F02D 29/04 |
| 9,200,431 | B2 * | 12/2015 | Mori | E02F 9/2232 |
| 9,518,593 | B2 * | 12/2016 | Mori | F04B 49/06 |
| 9,702,379 | B2 * | 7/2017 | Takahashi | F15B 11/16 |
| 9,835,180 | B2 * | 12/2017 | Takahashi | F15B 13/026 |
| 9,890,801 | B2 * | 2/2018 | Takahashi | F15B 11/17 |
| 9,963,856 | B2 * | 5/2018 | Takahashi | F15B 11/17 |
| 10,100,495 | B2 * | 10/2018 | Takahashi | F15B 13/06 |
| 10,107,311 | B2 * | 10/2018 | Takahashi | F15B 11/17 |
| 10,215,198 | B2 * | 2/2019 | Takahashi | F15B 11/17 |
| 10,280,592 | B2 * | 5/2019 | Takahashi | E02F 9/2095 |
| 2003/0200747 | A1 * | 10/2003 | Matsumoto | E02F 9/2235 60/452 |
| 2013/0287601 | A1 * | 10/2013 | Mori | E02F 9/2225 417/364 |
| 2014/0069091 | A1 | 3/2014 | Franzoni et al. | |
| 2015/0240455 | A1 * | 8/2015 | Takebayashi | E02F 9/2203 60/421 |
| 2016/0333900 | A1 * | 11/2016 | Takahashi | F15B 11/17 |

FOREIGN PATENT DOCUMENTS

| | | | |
|---|---|---|---|
| JP | 2003-156006 | A | 5/2003 |
| JP | 2007-024103 | A | 2/2007 |
| JP | 2009-167618 | A | 7/2009 |
| JP | 2010-047983 | A | 3/2010 |

* cited by examiner

HYDRAULIC DRIVE SYSTEM FOR CONSTRUCTION MACHINE

TECHNICAL FIELD

The present invention relates to a hydraulic drive system for a construction machine such as a hydraulic excavator, and in particular, to a hydraulic drive system for a construction machine that performs the load sensing control on the delivery flow rate of a hydraulic pump so that the delivery pressure of the hydraulic pump becomes higher than the maximum load pressure of a plurality of actuators by a target differential pressure.

BACKGROUND ART

Hydraulic drive systems for construction machines such as hydraulic excavators include those controlling the delivery flow rate of the hydraulic pump (main pump) so that the delivery pressure of the hydraulic pump becomes higher than the maximum load pressure of a plurality of actuators by a target differential pressure. This control is called "load sensing control". In such a hydraulic drive system performing the load sensing control, the differential pressure across each of a plurality of flow control valves is kept at a prescribed differential pressure by use of a pressure compensating valve to make it possible during the combined operation (driving two or more actuators at the same time) to supply the hydraulic fluid to the actuators according to a ratio corresponding to the opening areas of the flow control valves irrespective of the magnitude of the load pressure of each actuator.

In such hydraulic drive systems performing the load sensing control, each pressure compensating valve is generally configured to fully close when the spool moving in the direction of decreasing the opening area reaches the stroke end, as described in Patent Literature 1, for example.

Meanwhile, Patent Literature 2 describes a hydraulic drive system that is configured so that each pressure compensating valve does not fully close even when the spool moving in the direction of decreasing the opening area reaches the stroke end.

PRIOR ART LITERATURE

Patent Literature

Patent Literature 1: JP, A 2007-24103
Patent Literature 2: JP, A 7-76861

SUMMARY OF THE INVENTION

Problem to be Solved by the Invention

However, the conventional technologies described above involve the following problems:

As mentioned above, in the conventional hydraulic drive systems performing the load sensing control (such as the system described in the Patent Literature 1), the differential pressure across each of the flow control valves is kept at a prescribed differential pressure by use of a pressure compensating valve, making it possible during the combined operation (driving two or more actuators at the same time) to supply the hydraulic fluid to the actuators according to the ratio corresponding to the opening areas of the flow control valves irrespective of the load pressures.

However, since the delivery flow rate of the hydraulic pump has a certain upper limit (available maximum delivery flow rate), a state in which the delivery flow rate of the hydraulic pump is insufficient (hereinafter referred to as "saturation") occurs when the hydraulic pump reaches the available maximum delivery flow rate during the combined operation driving two or more actuators at the same time.

In the hydraulic drive system described in the Patent Literature 1, differential pressure between the delivery pressure of the hydraulic pump and the maximum load pressure of the plurality of actuators (hereinafter referred to as "load sensing differential pressure") is lead to the pressure receiving part of each pressure compensating valve (for operating the valve in the direction of increasing the opening area) as a target compensation differential pressure. By setting the target compensation differential pressures of the pressure compensating valves at the same value equivalent to the load sensing differential pressure, the differential pressures across the flow control valves are kept at the load sensing differential pressure. With this configuration, when the saturation occurs during the combined operation (driving two or more actuators at the same time), the load sensing differential pressure also drops according to the degree of the saturation and the target compensation differential pressures of the pressure compensating valves (i.e., the differential pressures across the flow control valves) decrease uniformly. Consequently, the delivery flow rate of the hydraulic pump can be redistributed among the actuators according to the ratio among the demanded flow rates of the actuators.

However, in cases where the pressure compensating valves are configured to fully close at the stroke end in the direction of decreasing the opening area as in the hydraulic drive system of the Patent Literature 1, if the saturation occurs during combined operation with a great load pressure difference between two actuators, the pressure compensating valve on the low load pressure side can be restricted extremely or closed, by which the actuator on the low load side can be decelerated or stopped.

In the hydraulic drive system described in the Patent Literature 2, the pressure compensating valves are configured not to fully close at the stroke end in the direction of decreasing the opening area. Thus, the pressure compensating valve on the low load side is never restricted extremely or closed even when the saturation occurs during the aforementioned type of combined operation. Consequently, the deceleration/stoppage of the actuator on the low load side can be prevented.

Nevertheless, the hydraulic drive system of the Patent Literature 2 has the following problem: When the saturation occurs during combined operation in which the load pressure difference between two actuators becomes even greater, most of the delivery flow of the main pump is consumed by the actuator on the low load pressure side and this can cause stoppage of the actuator on the high load pressure side.

For example, when a non-travel actuator (e.g., the hydraulic cylinder for the boom, the arm or the bucket) is driven during the traveling of the construction machine, especially in a condition in which the travel load pressure tends to rise (e.g., ascending slope), the entire delivery flow from the hydraulic pump flows into actuators at lower load pressures (e.g., the boom cylinder, the arm cylinder and the bucket cylinder) than the travel motors, by which the traveling of the construction machine can be stopped.

Further, in combined operation of the traveling and the blade, quick operation on the blade during the traveling causes an instantaneous flow of the hydraulic fluid into the blade cylinder, which leads to deceleration/stoppage of the traveling and deterioration in the operational feel.

Besides the travel motors, the reserve actuator for an attachment (e.g., crusher) used in replacement with the bucket causes similar problems since the reserve actuator tends to rise to a high load pressure and the great load pressure difference occurs often in the combined operation with other actuators (e.g., the hydraulic cylinders for the boom, the arm and the bucket).

It is therefore the primary object of the present invention to provide a hydraulic drive system for a construction machine capable of achieving excellent operability in the combined operation by preventing the deceleration/stoppage of the actuator on the low load pressure side (by preventing the full closure of the pressure compensating valve on the low load pressure side) while also preventing the deceleration/stoppage of the high load pressure actuator (by securing a necessary amount of hydraulic fluid for the high load pressure actuator) when the saturation occurs in a hydraulic drive system performing the load sensing control due to the combined operation with a great load pressure difference between two actuators.

In this DESCRIPTION, a term "specific actuator" is used to mean an actuator whose load pressure rises to a high level (e.g., the travel motors and the reserve actuator for the crusher or the like) and which can stop due to the consumption of most of the delivery flow rate of the main pump by other actuators on the low load pressure side when the saturation occurs in a hydraulic drive system comprising pressure compensating valves of the type in which full closing of the valves is not attained at the stroke end in the direction of decreasing the opening area like the system described in the Patent Literature 2 due to combined operation with a great load pressure difference.

Means for Solving the Problem

To achieve the above object, the present invention provides a hydraulic drive system for a construction machine, comprising: a variable displacement type hydraulic pump; a plurality of actuators which are driven by hydraulic fluid delivered from the hydraulic pump; a plurality of flow control valves which control flow rates of the hydraulic fluid supplied from the hydraulic pump to the actuators; a plurality of operating devices provided corresponding to the actuators and including remote control valves for generating operation pilot pressures for driving the flow control valves; a plurality of pressure compensating valves which respectively control differential pressures across the flow control valves; and a pump control system which performs load sensing control on displacement of the hydraulic pump so that delivery pressure of the hydraulic pump becomes higher than maximum load pressure of the actuators by a target differential pressure. The pressure compensating valves are of the type in which full closing of the valves is not attained at the stroke end in the direction of decreasing the opening area. The hydraulic drive system comprises a pilot primary pressure circuit which supplies pilot primary pressure, as pressure of a pilot hydraulic pressure source, to the remote control valves of the operating devices. The pilot primary pressure circuit includes a first circuit which supplies the pilot primary pressure to the remote control valves of one or more specific operating devices among the plurality of operating devices corresponding to one or more specific actuators and a second circuit which supplies the pilot primary pressure to the remote control valves of operating devices other than the specific operating devices. When the specific operating devices are not operated, the second circuit supplies the pilot primary pressure directly to the remote control valves of the operating devices other than the specific operating devices. When the specific operating devices are operated, the second circuit reduces the pilot primary pressure and supplies the reduced pilot primary pressure to the remote control valves of the operating devices other than the specific operating devices.

In the hydraulic drive system configured as above, the pressure compensating valves are of the type in which full closing of the valves is not attained at the stroke end in the direction of decreasing the opening area. Therefore, even when the saturation occurs due to the combined operation with a great load pressure difference between two actuators, the full closure of the pressure compensating valve on the low load pressure side is prevented, by which the deceleration/stoppage of the actuator on the low load pressure side can be prevented.

Further, the second circuit supplies the pilot primary pressure directly to the remote control valves of the operating devices other than the specific operating devices when the specific operating devices are not operated, while reducing the pilot primary pressure and supplying the reduced pilot primary pressure to the remote control valves of the operating devices other than the specific operating devices when the specific operating devices are operated. Therefore, the inflow of the hydraulic fluid into the actuators corresponding to the operating devices other than the specific operating devices is suppressed. Consequently, even when the saturation occurs during combined operation in which the specific actuator is on the high load pressure side and the load pressure difference is great, the necessary amount of hydraulic fluid for the specific actuator (high load pressure actuator) is secured, the deceleration/stoppage of the specific actuator is prevented, and excellent operability in the combined operation is achieved.

In the present invention, the second circuit can be implemented in various configurations.

For example, the second circuit may include: a third circuit which directly supplies the pilot primary pressure; a fourth circuit which reduces the pilot primary pressure and supplies the reduced pilot primary pressure; and a selector valve which makes a selection from pressure of the third circuit and pressure of the fourth circuit and supplies the selected pressure to the remote control valves of the operating devices other than the specific operating devices.

In this case, the fourth circuit may include a pressure reducing valve which reduces the pilot primary pressure. The fourth circuit may also be configured to include a restrictor circuit which reduces the pilot primary pressure.

The second circuit may also be configured to include: a fifth circuit having a pilot-operated pressure reducing valve and leading the pilot primary pressure directly to the remote control valves of the operating devices other than the specific operating devices when pilot pressure lead to the pilot-operated pressure reducing valve is at a first pressure, while reducing the pilot primary pressure and leading the reduced pilot primary pressure to the remote control valves of the operating devices other than the specific operating devices when the pilot pressure lead to the pilot-operated pressure reducing valve is switched to a second pressure; and a sixth circuit having a selector valve which switches the pilot pressure lead to the pilot-operated pressure reducing valve between the first pressure and the second pressure.

Preferably, the hydraulic drive system further comprises an operation detection device which detects operation of the specific operating devices corresponding to the specific actuators. When the operation detection device detects no operation of the specific operating devices, the second circuit supplies the pilot primary pressure directly to the remote control valves of the operating devices other than the specific operating devices. When the operation detection device detects the operation of the specific operating devices, the second circuit reduces the pilot primary pressure and supplies the reduced pilot primary pressure to the remote control valves of the operating devices other than the specific operating devices.

The hydraulic drive system may further comprise shuttle valves which detect the operation pilot pressures generated by the remote control valves of the specific operating devices corresponding to the specific actuators and output the detected operation pilot pressures as hydraulic signals as the operation detection device. In this case, the selector valve is a hydraulic selector valve which is switched by the hydraulic signals.

Alternatively, the hydraulic drive system may further comprise a pressure sensor which outputs an electric signal by detecting the operation pilot pressures generated by the remote control valves of the specific operating devices corresponding to the specific actuators as the operation detection device. In this case, the selector valve is a solenoid selector valve which operates according to the electric signal.

The hydraulic drive system may further comprise a manual selection device which can be switched between a first position and a second position. When the manual selection device is at the first position, the second circuit enables the function of reducing the pilot primary pressure when the specific operating devices are operated. When the manual selection device is switched to the second position, the second circuit disables the function of reducing the pilot primary pressure when the specific operating devices are operated.

Effect of the Invention

According to the present invention, when the saturation occurs in a hydraulic drive system performing the load sensing control due to the combined operation with a great load pressure difference between two actuators, the deceleration/stoppage of the actuator on the low load pressure side is prevented by preventing the full closure of the pressure compensating valve on the low load pressure side, while also preventing the deceleration/stoppage of the high load pressure actuator by securing a necessary amount of hydraulic fluid for the high load pressure actuator. Consequently, excellent operability in the combined operation is achieved.

MODE FOR CARRYING OUT THE INVENTION

Figure 1A:
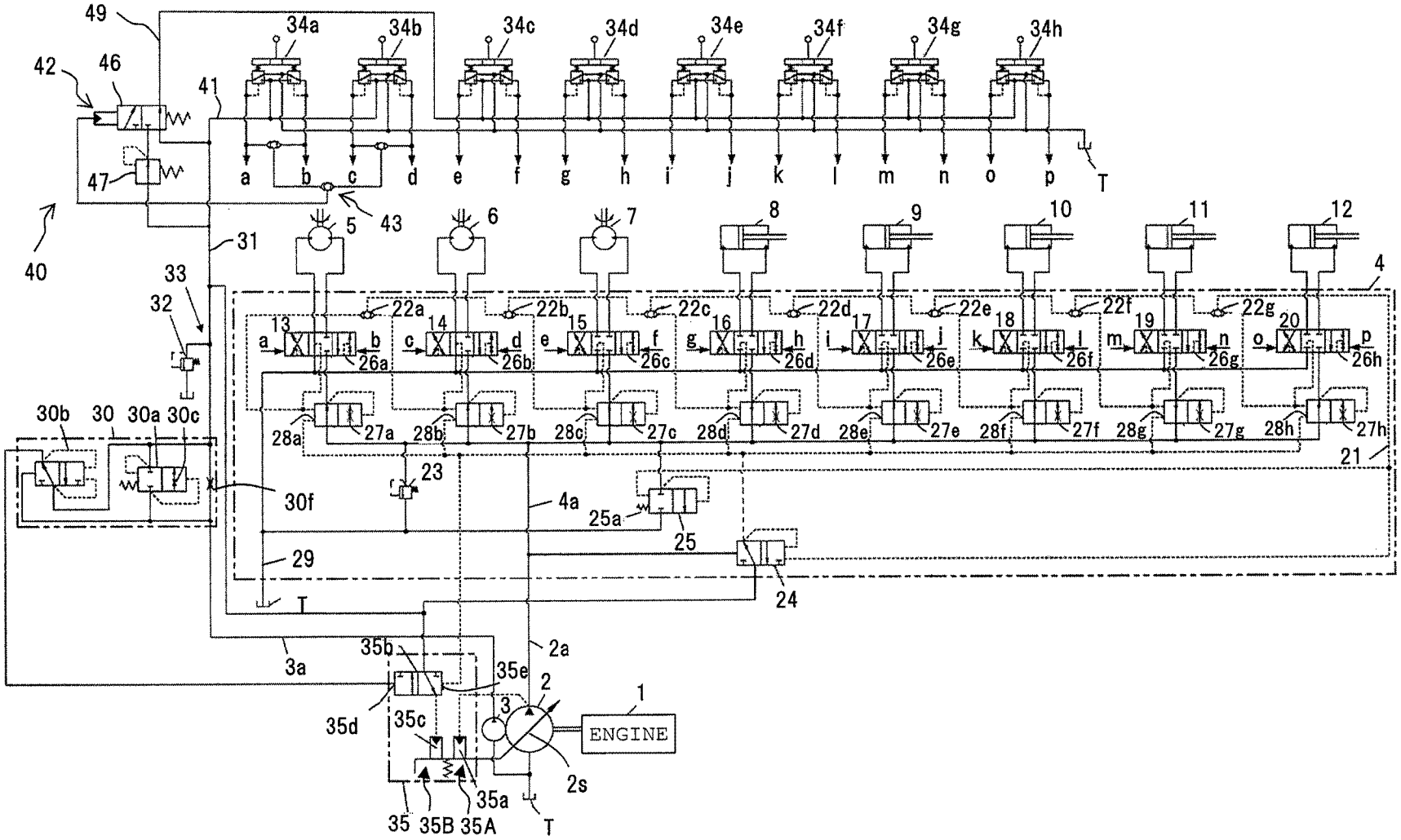
FIG. 1A is a schematic diagram showing a hydraulic drive system for a hydraulic excavator in accordance with a first embodiment of the present invention.

Referring now to the drawings, a description will be given in detail of preferred embodiments of the present invention.

<Hydraulic Excavator>

Figure 2:
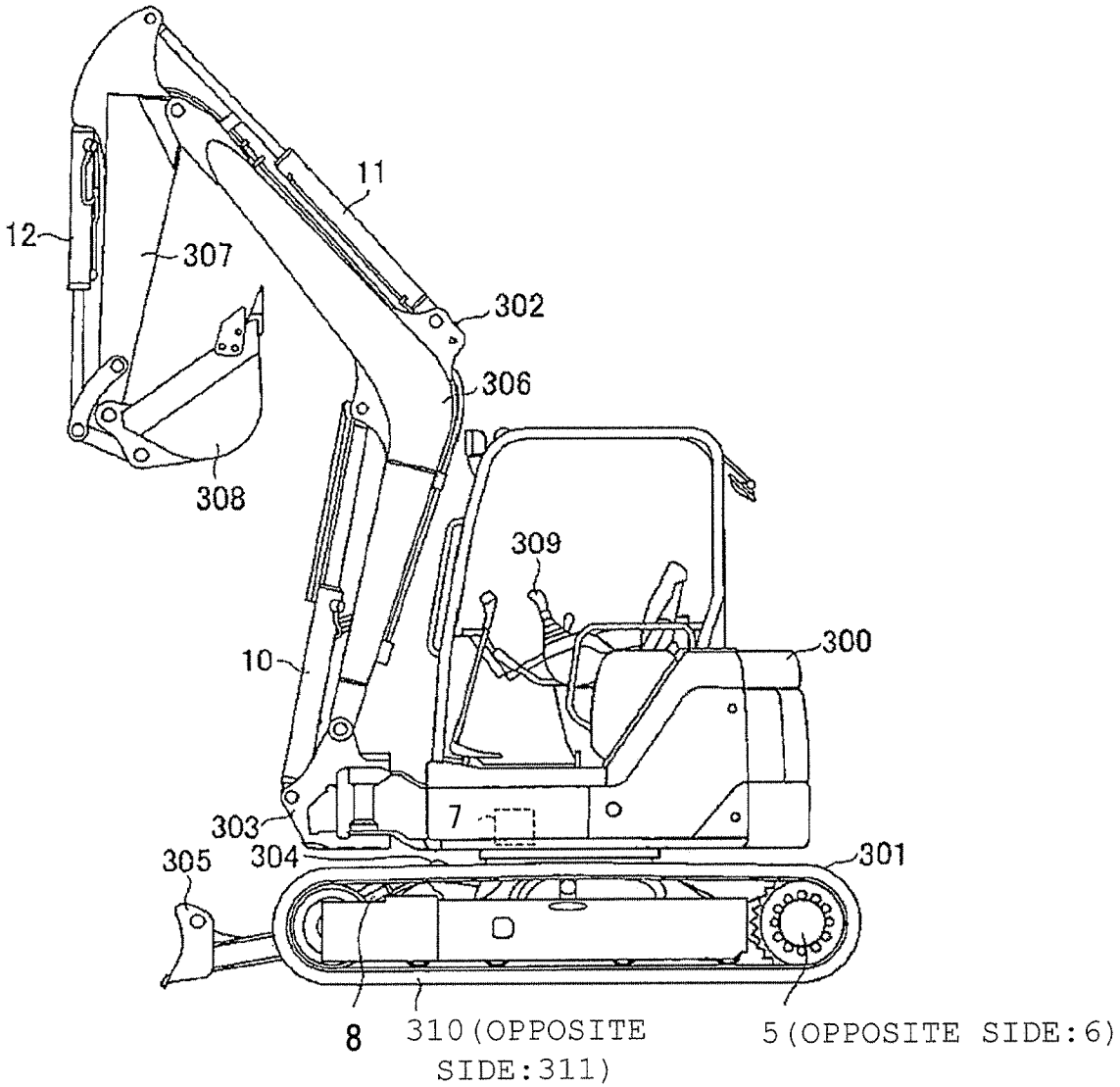
FIG. 2 is a schematic diagram showing the external appearance of the hydraulic excavator as an example of the construction machine.

FIG. 2 shows the external appearance of a hydraulic excavator.

Referring to FIG. 2, the hydraulic excavator (well known as a work machine) comprises an upper swing structure 300, a lower track structure 301, and a front work implement 302 of the swinging type. The front work implement 302 is made up of a boom 306, an arm 307 and a bucket 308. The upper swing structure 300 is capable of rotating the lower track structure 301 by the rotation of a swing motor 7. A swing post 303 is attached to the front part of the upper swing structure 300. The front work implement 302 is attached to the swing post 303 to be movable up and down. The swing post 303 can be horizontally rotated (swung) with respect to the upper swing structure 300 by the expansion/contraction of a swing cylinder 9 (see FIG. 1). The boom 306, the arm 307 and the bucket 308 of the front work implement 302 can be vertically rotated by the expansion/contraction of a boom cylinder 10, an arm cylinder 11 and a bucket cylinder 12. The lower track structure 301 has a center frame 304. A blade 305 which is moved up and down by the expansion/contraction of a blade cylinder 8 (see FIG. 1A) is attached to the center frame 304. The lower track structure 301 travels by driving left and right crawlers 310 and 311 by the rotation of travel motors 5 and 6.

First Embodiment

FIG. 1A shows a hydraulic drive system for a hydraulic excavator in accordance with a first embodiment of the present invention.

(Basic Configuration)

First, the basic configuration of the hydraulic drive system according to this embodiment will be described below.

The hydraulic drive system in this embodiment comprises an engine 1, a main hydraulic pump (hereinafter referred to as a "main pump") 2 which is driven by the engine 1, a pilot pump 3 which is driven by the engine 1 in conjunction with the main pump 2, a plurality of actuators 5, 6, 7, 8, 9, 10, 11 and 12 which are driven by the hydraulic fluid delivered from the main pump 2 (i.e., the left and right travel motors 5 and 6, the swing motor 7, the blade cylinder 8, the swing cylinder 9, the boom cylinder 10, the arm cylinder 11 and the bucket cylinder 12), and a control valve 4. The hydraulic excavator in this embodiment is a mini-excavator, for example.

The control valve 4 includes a plurality of valve sections 13, 14, 15, 16, 17, 18, 19 and 20, a plurality of shuttle valves 22*a*, 22*b*, 22*c*, 22*d*, 22*e*, 22*f* and 22*g*, a main relief valve 23, a differential pressure reducing valve 24, and an unload valve 25. The valve sections 13, 14, 15, 16, 17, 18, 19 and 20 are connected to a supply line 2*a* of the main pump 2. Each valve section 13, 14, 15, 16, 17, 18, 19, 20 controls the direction and the flow rate of the hydraulic fluid supplied from the main pump 2 to each actuator. The shuttle valves 22*a*, 22*b*, 22*c*, 22*d*, 22*e*, 22*f* and 22*g* select the highest load pressure PLmax from the load pressures of the actuators 5, 6, 7, 8, 9, 10, 11 and 12 (hereinafter referred to as "the maximum load pressure PLmax") and output the maximum load pressure PLmax to a signal hydraulic line 21. The main relief valve 23 is connected to an in-valve supply line 4*a* which is connected to the supply line 2*a* of the main pump 2 and limits the maximum delivery pressure of the main pump 2 (maximum pump pressure). The differential pressure reducing valve 24 is connected to a pilot hydraulic pressure source 33 (explained later), receives the pressures in the supply line 4*a* and the signal hydraulic line 21 as signal pressures, and outputs the differential pressure PLS between the delivery pressure (pump pressure) Pd of the main pump 2 and the maximum load pressure PLmax as an absolute pressure. The unload valve 25 is connected to the in-valve supply line 4*a*, receives the pressures in the supply line 4*a* and the signal hydraulic line 21 as signal pressures, and keeps the differential pressure PLS within a constant value that is set by a spring 25*a* by returning part of the delivery flow of the main pump 2 to a tank T when the differential pressure PLS between the pump pressure Pd and the maximum load pressure PLmax exceeds the constant value set by the spring 25*a*. The outlet side of the unload valve 25 and the outlet side of the main relief valve 23 are connected to an in-valve tank line 29 and connected to the tank T via the line 29.

The valve section 13 is formed of a flow control valve 26*a* and a pressure compensating valve 27*a*. The valve section 14 is formed of a flow control valve 26*b* and a pressure compensating valve 27*b*. The valve section 15 is formed of a flow control valve 26*c* and a pressure compensating valve 27*c*. The valve section 16 is formed of a flow control valve 26*d* and a pressure compensating valve 27*d*. The valve section 17 is formed of a flow control valve 26*e* and a pressure compensating valve 27*e*. The valve section 18 is formed of a flow control valve 26*f* and a pressure compensating valve 27*f*. The valve section 19 is formed of a flow control valve 26*g* and a pressure compensating valve 27*g*. The valve section 20 is formed of a flow control valve 26*h* and a pressure compensating valve 27*h*.

Each flow control valve 26*a*-26*h* controls the direction and the flow rate of the hydraulic fluid supplied from the main pump 2 to each actuator 5-12. Each pressure compensating valve 27*a*-27*h* controls the differential pressure across each flow control valve 26*a*-26*h*.

Each pressure compensating valve 27*a*-27*h* has a valve-opening pressure receiving part 28*a*, 28*b*, 28*c*, 28*d*, 28*e*, 28*f*, 28*g*, 28*h* for setting a target differential pressure. The output pressure of the differential pressure reducing valve 24 is lead to the pressure receiving parts 28*a*-28*h*. A target compensation differential pressure is set to the pressure receiving parts 28*a*-28*h* according to the absolute pressure of the differential pressure PLS between the hydraulic pump pressure Pd and the maximum load pressure PLmax (hereinafter referred to as "absolute pressure PLS"). By controlling the differential pressures across the flow control valves 26*a*-26*h* at the same value (PLS) as above, the pressure compensating valves 27*a*-27*h* carry out control so that the differential pressures across the flow control valves 26*a*-26*h* equal the differential pressure PLS between the hydraulic pump pressure Pd and the maximum load pressure PLmax. As a result, in the combined operation in which two or more actuators are driven at the same time, the delivery flow rate (delivery flow) of the main pump 2 can be properly distributed according to the opening area ratio among the flow control valves 26*a*-26*h* irrespective of the magnitude of the load pressure of each actuator 5-12, by which excellent operability in the combined operation can be secured. Further, in the saturation state in which the delivery flow rate of the main pump 2 is less than the demanded flow rate, the differential pressure PLS drops according to the degree of the supply deficiency. Accordingly, the differential pressures across the flow control valves 26*a*-26*h* (controlled by the pressure compensating valves 27*a*-27*h*) drop at the same ratio and the flow rates through the flow control valves 26*a*-26*h* decrease at the same ratio. Therefore, also in this case, the delivery flow rate (delivery flow) of the main pump 2 can be properly distributed according to the opening area ratio among the flow control valves 26*a*-26*h* and excellent operability in the combined operation can be secured.

As is clear from the symbol representation in FIG. 1A, the pressure compensating valves 27*a*-27*h* are pressure compensating valves of the type in which full closing of the valves is not attained at the stroke end in the direction of decreasing the opening area (leftward in FIG. 1A).

The hydraulic drive system further comprises an engine revolution speed detection valve 30, a pilot hydraulic pressure source 33, and operating devices 34*a*, 34*b*, 34*c*, 34*d*, 34*e*, 34*f*, 34*g* and 34*h*. The engine revolution speed detection valve 30 is connected to a supply line 3*a* of the pilot pump 3 and outputs absolute pressure corresponding to the delivery flow rate of the pilot pump 3. The pilot hydraulic pressure source 33 is connected to the downstream side of the engine revolution speed detection valve 30. The pilot hydraulic pressure source 33 has a pilot relief valve 32 which maintains the pressure in a pilot line 31 at a constant level. The operating devices 34*a*, 34*b*, 34*c*, 34*d*, 34*e*, 34*f*, 34*g* and 34*h* are connected to the pilot line 31. The operating devices 34*a*, 34*b*, 34*c*, 34*d*, 34*e*, 34*f*, 34*g* and 34*h* are respectively equipped with remote control valves 34*a*-2, 34*b*-2, 34*c*-2, 34*d*-2, 34*e*-2, 34*f*-2, 34*g*-2 and 34*h*-2 (see FIG. 1B) that generate operation pilot pressures (pilot secondary pressures) a, b, c, d, e, f, g, h, i, j, k, l, m, n, o and p for operating the flow control valve 26*a* by using the pressure of the pilot hydraulic pressure source 33 as the source pressure (pilot primary pressure).

The engine revolution speed detection valve 30 includes a restrictor element (fixed restrictor part) 30*f* which is arranged in a hydraulic line connecting the supply line 3*a* of the pilot pump 3 to the pilot line 31, a flow rate detection valve 30*a* which is connected in parallel with the restrictor element 30*f*, and a differential pressure reducing valve 30*b*. The input side of the flow rate detection valve 30*a* is connected to the supply line 3*a* of the pilot pump 3, while the output side of the flow rate detection valve 30*a* is connected to the pilot line 31. The flow rate detection valve 30*a* has a variable restrictor part 30*c* which increases its opening area with the increase in the flow rate. The hydraulic fluid delivered from the pilot pump 3 can flow into the pilot line 31 through either the restrictor element 30*f* or the variable restrictor part 30*c* of the flow rate detection valve 30*a*. In this case, differential pressure that increases with the increase in the flow rate occurs across the restrictor element 30*f* and the variable restrictor part 30*c* of the flow rate detection valve 30*a*. The differential pressure reducing valve 30*b* outputs the differential pressure as absolute pressure Pa. Since the delivery flow rate of the pilot pump 3 changes according to the revolution speed of the engine 1, the delivery flow rate of the pilot pump 3 and the revolution speed of the engine 1 can be measured by detecting the differential pressure across the restrictor element 30*f* and the variable restrictor part 30*c*. The variable restrictor part 30*c* is configured so as to reduce the degree of increase of the differential pressure with the increase in the flow rate, by increasing the opening area with the increase in the flow rate (i.e., with the increase in the differential pressure).

The main pump 2 is a variable displacement type hydraulic pump. The main pump 2 is equipped with a pump control system 35 for controlling the tilting angle (displacement) of the main pump 2. The pump control system 35 includes a pump torque control unit 35A and an LS control unit 35B.

The pump torque control unit 35A includes a torque control tilting actuator 35*a*. The torque control tilting actuator 35*a* limits the input torque of the main pump 2 so as not to exceed preset maximum torque, by driving the swash plate 2*s* (variable displacement member) of the main pump 2 to reduce its tilting angle (displacement) when the delivery pressure of the main pump 2 becomes high. By this operation, the power consumption of the main pump 2 is limited and the stoppage of the engine 1 due to the overload (engine stall) is prevented.

The LS control unit 35B includes an LS control valve 35*b* and an LS control tilting actuator 35*c*.

The LS control valve 35*b* has pressure receiving parts 35*d* and 35*e* opposing each other. To the pressure receiving part 35*d*, the absolute pressure Pa generated by the differential pressure reducing valve 30*b* of the engine revolution speed detection valve 30 is lead via a hydraulic line 40 as the target differential pressure of the load sensing control (target LS differential pressure). To the pressure receiving part 35*e*, the absolute pressure PLS (i.e., the differential pressure PLS between the delivery pressure Pd of the main pump 2 and the maximum load pressure PLmax) generated by the differential pressure reducing valve 24 is lead as feedback differential pressure. When the absolute pressure PLS exceeds the absolute pressure Pa (PLS>Pa), the LS control valve 35*b* leads the pressure of the pilot hydraulic pressure source 33 to the LS control tilting actuator 35*c*. When the absolute pressure PLS falls below the absolute pressure Pa (PLS<Pa), the LS control valve 35*b* connects the LS control tilting actuator 35*c* to the tank T. When the pressure of the pilot hydraulic pressure source 33 is lead thereto, the LS control tilting actuator 35*c* drives the swash plate 2*s* of the main pump 2 to decrease the tilting angle of the main pump 2. When connected to the tank T, the LS control tilting actuator 35*c* drives the swash plate 2*s* of the main pump 2 to increase the tilting angle of the main pump 2. By this operation, the tilting angle (displacement) of the main pump 2 is controlled so that the delivery pressure Pd of the main pump 2 becomes higher than the maximum load pressure PLmax by the absolute pressure Pa (target differential pressure).

Incidentally, since the absolute pressure Pa is a value changing according to the engine revolution speed, actuator speed control according to the engine revolution speed becomes possible by using the absolute pressure Pa as the target differential pressure of the load sensing control and setting the target compensation differential pressure of the pressure compensating valves 27*a*-27*h* by using the absolute pressure PLS of the differential pressure between the delivery pressure Pd of the main pump 2 and the maximum load pressure PLmax.

The preset pressure of the spring 25*a* of the unload valve 25 has been set to be slightly higher than the absolute pressure Pa (the target differential pressure of the load sensing control) that is generated by the differential pressure reducing valve 30*b* of the engine revolution speed detection valve 30 when the engine 1 is at its rated maximum revolution speed.

Figure 1B:
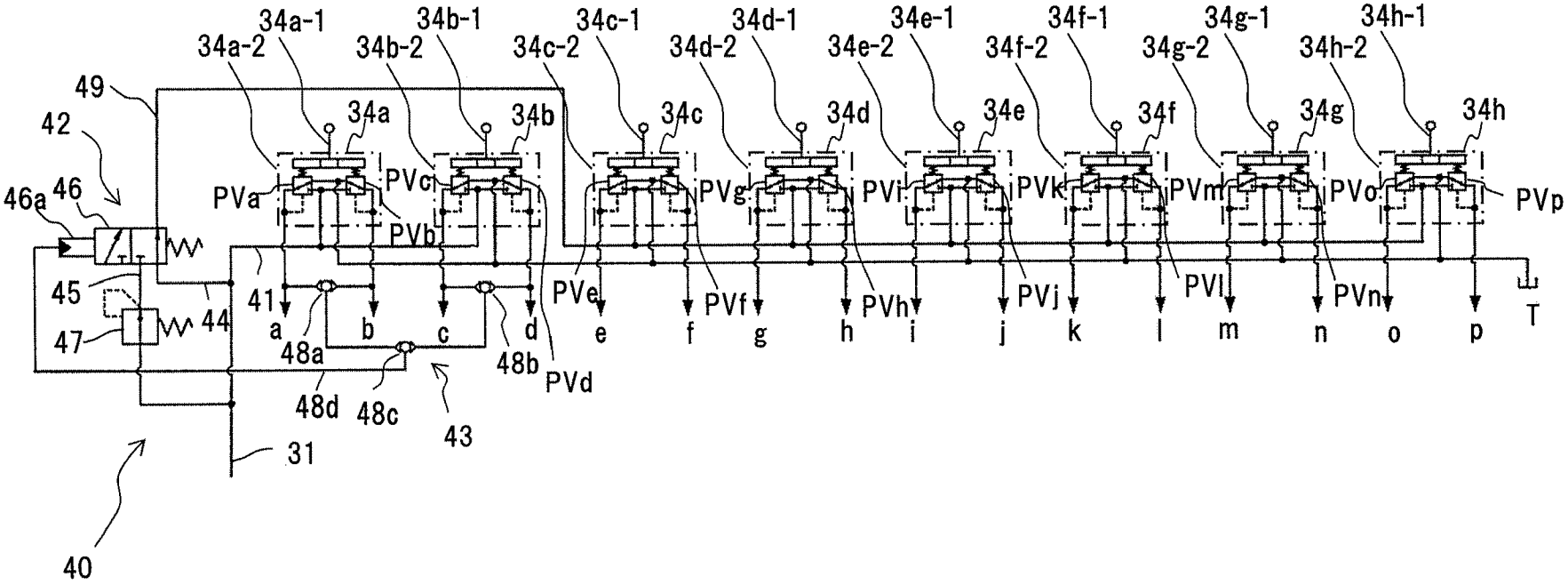
FIG. 1B is an enlarged view showing a plurality of operating devices and their pilot circuit.

FIG. 1B is an enlarged view showing the operating devices 34*a*, 34*b*, 34*c*, 34*d*, 34*e*, 34*f*, 34*g* and 34*h* and their pilot circuit.

The operating device 34*a* includes a control lever 34*a*-1 and a remote control valve 34*a*-2. The remote control valve 34*a*-2 has a pair of pressure reducing valves PVa and PVb. When the control lever 34*a*-1 is operated rightward in FIG. 1B, the pressure reducing valve PVa of the remote control valve 34*a*-2 operates to generate an operation pilot pressure "a" having magnitude corresponding to the operation amount of the control lever 34*a*-1. When the control lever 34*a*-1 is operated leftward in FIG. 1B, the pressure reducing valve PVb of the remote control valve 34*a*-2 operates to generate an operation pilot pressure "b" having magnitude corresponding to the operation amount of the control lever 34*a*-1.

The operating devices 34*b*-34*h* are also configured in the same way. Specifically, each operating device 34*b*-34*h* includes a control lever 34*b*-1, 34*c*-1, 34*d*-1, 34*e*-1, 34*f*-1, 34*g*-1, 34*h*-1 and a remote control valve 34*b*-2, 34*c*-2, 34*d*-2, 34*e*-2, 34*f*-2, 34*g*-2, 34*h*-2. When the control lever 34*b*-1, 34*c*-1, 34*d*-1, 34*e*-1, 34*f*-1, 34*g*-1, 34*h*-1 is operated rightward in FIG. 1B, the pressure reducing valve PVc, PVe, PVg, PVi, PVk, PVm, PVo of the remote control valve 34*b*-2, 34*c*-2, 34*d*-2, 34*e*-2, 34*f*-2, 34*g*-2, 34*h*-2 operates to generate an operation pilot pressure "c", "e", "g", "i", "k", "m", "o" having magnitude corresponding to the operation amount of the control lever 34*b*-1, 34*c*-1, 34*d*-1, 34*e*-1, 34*f*-1, 34*g*-1, 34*h*-1. When the control lever 34*b*-1, 34*c*-1, 34*d*-1, 34*e*-1, 34*f*-1, 34*g*-1, 34*h*-1 is operated leftward in FIG. 1B, the pressure reducing valve PVd, PVf, PVh, PVj, PVl, PVn, PVp of the remote control valve 34*b*-2, 34*c*-2, 34*d*-2, 34*e*-2, 34*f*-2, 34*g*-2, 34*h*-2 operates to generate an operation pilot pressure "d", "f", "h", "j", "l", "n", "p" having magnitude corresponding to the operation amount of the control lever 34*b*-1, 34*c*-1, 34*d*-1, 34*e*-1, 34*f*-1, 34*g*-1, 34*h*-1.

(Characteristic Configuration)

Next, a configuration that is characteristic of the hydraulic drive system according to this embodiment will be described below.

The hydraulic drive system according to this embodiment comprises, as its characteristic configuration, a pilot primary pressure circuit 40 which supplies the pilot primary pressure (i.e., the pressure of the pilot hydraulic pressure source 33) to the remote control valves 34*a*-2, 34*b*-2, 34*c*-2, 34*d*-2, 34*e*-2, 34*f*-2, 34*g*-2 and 34*h*-2 of the operating devices 34*a*, 34*b*, 34*c*, 34*d*, 34*e*, 34*f*, 34*g* and 34*h*. The pilot primary pressure circuit 40 includes a first circuit 41 which supplies the pilot primary pressure to the remote control valves 34*a*-2 and 34*b*-2 of the travel operating devices 34*a* and 34*b* and a second circuit 42 which supplies the pilot primary pressure to the remote control valves 34*c*-2-34*h*-2 of the operating devices 34*c*-34*h* other than the travel operating devices (hereinafter referred to simply as "non-travel operating devices).

The second circuit 42 is configured as below. When the travel operating devices 34*a* and 34*b* are not operated, the second circuit 42 supplies the pilot primary pressure directly to the remote control valves 34*c*-2-34*h*-2 of the non-travel operating devices 34*c*-34*h*. When the travel operating devices 34*a* and 34*b* are operated, the second circuit 42 reduces the pilot primary pressure and supplies the reduced pilot primary pressure to the remote control valves 34*c*-2-34*h*-2 of the non-travel operating devices 34*c*-34*h*.

The travel motors 5 and 6 are specific actuators, and the travel operating devices 34*a* and 34*b* are specific operating devices corresponding to the specific actuators (the travel motors 5 and 6) among the operating devices 34*a*-34*h*. In this DESCRIPTION, the term "specific actuator" means an actuator of the following type: In combined operation in which the specific actuator and another actuator (latter actuator) are driven at the same time, the latter actuator stays on the low load pressure side and the load pressure of the specific actuator rises to such an extent that the pressure compensating valve of the latter actuator (actuator on the low load side) operates to a position close to the stroke end.

The hydraulic drive system according to this embodiment further comprises an operation detection device 43 which detects the operation of the travel operating devices 34*a* and 34*b*. The operation detection device 43 includes shuttle valves 48*a*, 48*b* and 48*c* for detecting the operation pilot pressures generated by the remote control valves 34*a*-2 and 34*b*-2 of the travel operating devices 34*a* and 34*b* (travel operation pilot pressures) and outputting the detected travel operation pilot pressures as a hydraulic signal. The second circuit 42 includes a third circuit 44 for directly supplying the pilot primary pressure, a fourth circuit 45 for reducing the pilot primary pressure and supplying the reduced pilot primary pressure, and a selector valve 46 for making a selection from (switching between) the pressure of the third circuit 44 and the pressure of the fourth circuit 45 and supplying the selected pressure to the remote control valves 34*c*-2-34*h*-2 of the non-travel operating devices 34*c*-34*h*. The fourth circuit 45 includes a pressure reducing valve 47 for reducing the pilot primary pressure. The selector valve 46 includes a pilot pressure receiving part 46*a* to which the hydraulic signal from the shuttle valves 48*a*, 48*b* and 48*c* is lead via a hydraulic line 48*d*.

When the control levers 34*a*-1 and 34*b*-1 of the travel operating devices 34*a* and 34*b* are not operated and no travel operation pilot pressure is generated, the selector valve 46 is situated at a first position (rightward in FIG. 1B). In this state, the third circuit 44 is connected to a circuit 49 that reaches the remote control valves 34*c*-2-34*h*-2 of the non-travel operating devices 34*c*-34*h*, by which the pilot primary pressure is directly supplied to the remote control valves 34*c*-2-34*h*-2 of the non-travel operating devices 34*c*-34*h*. In contrast, when the control levers 34*a*-1 and 34*b*-1 of the travel operating devices 34*a* and 34*b* are operated and the travel operation pilot pressure is generated, the travel operation pilot pressure is lead to the pilot pressure receiving part 46*a* of the selector valve 46 and the selector valve 46 is switched to a second position (leftward in FIG. 1B). In this state, the fourth circuit 45 is connected to the circuit 49 reaching the remote control valves 34*c*-2-34*h*-2 of the non-travel operating devices 34*c*-34*h*. The pilot primary pressure is reduced by the pressure reducing valve 47 and the reduced pilot primary pressure is supplied to the remote control valves 34*c*-2-34*h*-2 of the non-travel operating devices 34*c*-34*h*.

Figure 3A:
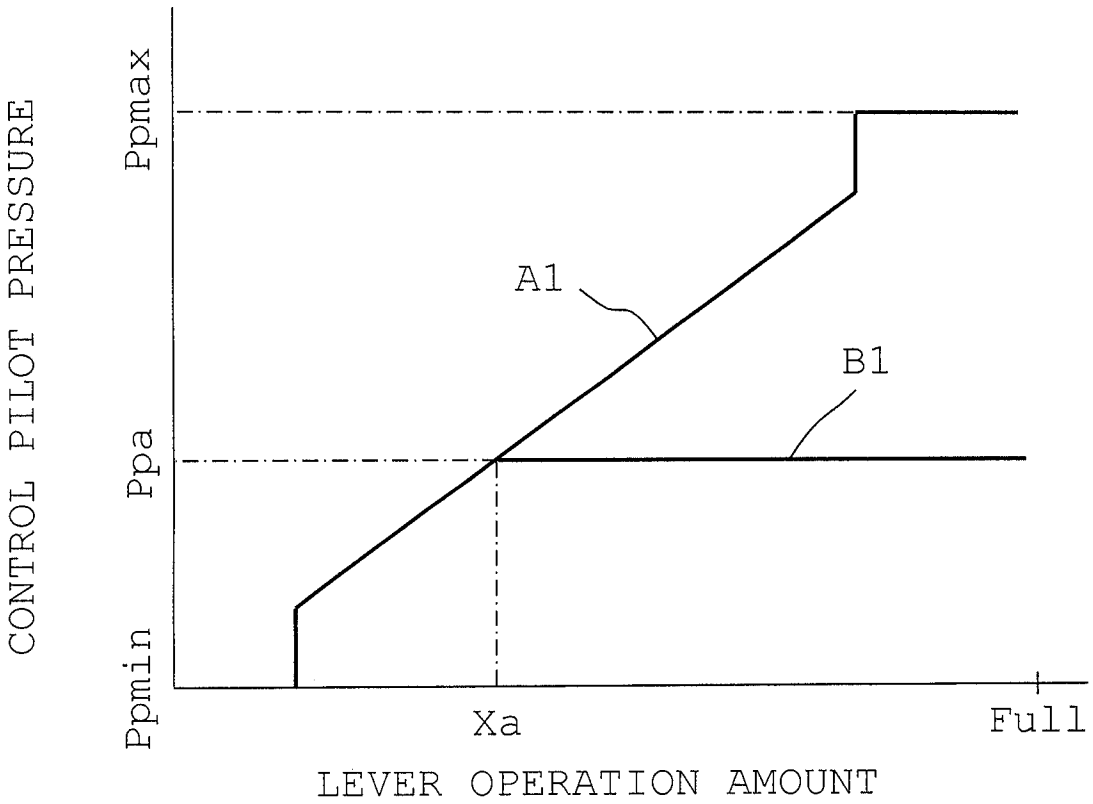
FIG. 3A is a graph showing the relationship between the lever operation amount of an operating device and operation pilot pressure generated by a remote control valve (operation pilot pressure characteristic).
Figure 3B:
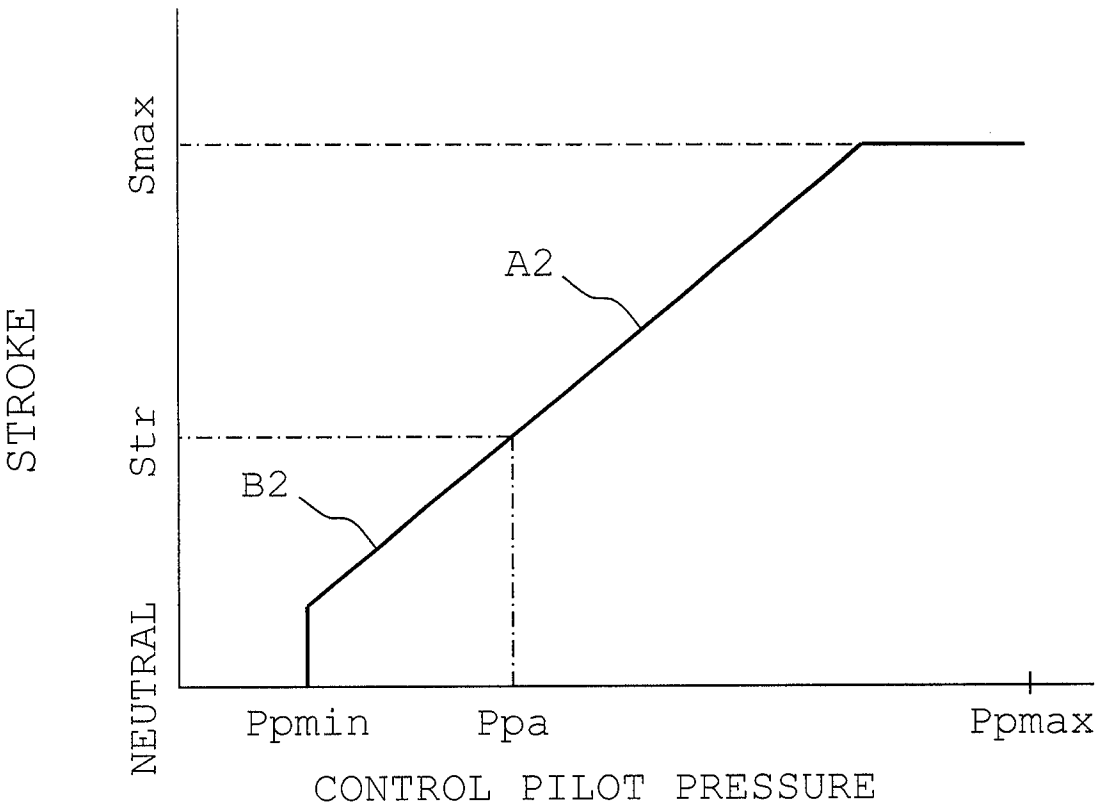
FIG. 3B is a graph showing the relationship between the operation pilot pressure generated by the remote control valve of the operating device and the spool stroke of a flow control valve (spool stroke characteristic).
Figure 3C:
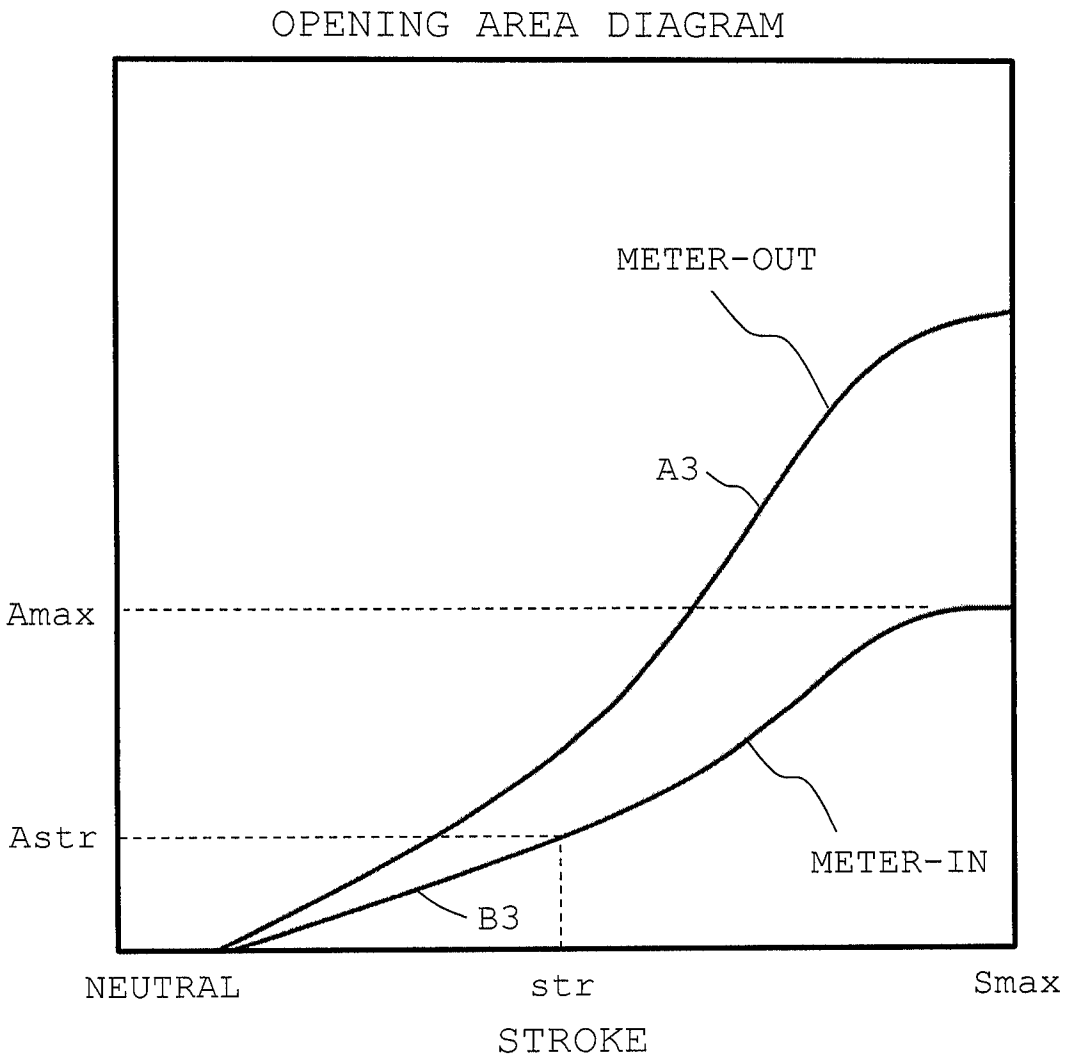
FIG. 3C is a graph showing the relationship between the spool stroke of the flow control valve and the opening area of the flow control valve 2 (opening area characteristic).

FIG. 3A-3C are graphs showing the change in the opening areas of the flow control valves 26*c*-26*h* in response to the lever operation amounts of the operating devices 34*c*-34*h* in this case.

When the control levers 34*a*-1 and 34*b*-1 of the travel operating devices 34*a* and 34*b* are not operated, no travel operation pilot pressure is generated, and thus the selector valve 46 is situated at the first position (rightward in FIG. 1B) and the pilot primary pressure of the pilot hydraulic pressure source 33 is directly supplied to the remote control valves 34*c*-2-34*h*-2 of the non-travel operating devices 34*c*-34*h*. Therefore, when any one of the control levers 34*c*-1-34*h*-1 of the non-travel operating devices 34*c*-34*h* is operated, the operation pilot pressure generated by the remote control valve 34*c*-2-34*h*-2, the spool stroke of the non-travel flow control valve 26*c*-26*h*, and the opening area of the non-travel flow control valve 26*c*-26*h* change like the characteristics A1, A2 and A3 shown in FIGS. 3A, 3B and 3C, respectively. Specifically, with the increase in the lever operation amount, the operation pilot pressure increases from a minimum pressure Ppmin to a maximum pressure Ppmax (characteristic A1 shown in FIG. 3A). With the increase in the operation pilot pressure, the spool stroke of the non-travel flow control valve 26*c*-26*h* increases from 0 to a maximum stroke Smax (characteristic A2 shown in FIG. 3B). With the increase in the spool stroke, the meter-in opening area increases from 0 to a maximum opening area Amax (characteristic A3 shown in FIG. 3C).

In contrast, when the control levers 34*a*-1 and 34*b*-1 of the travel operating devices 34*a* and 34*b* are operated, the travel operation pilot pressure is generated and the selector valve 46 is switched to the second position (leftward in FIG. 1B) to reduce the pilot primary pressure of the pilot hydraulic pressure source 33. Therefore, when any one of the control levers 34*c*-1-34*h*-1 of the non-travel operating devices 34*c*-34*h* is operated, the operation pilot pressure generated by the remote control valve 34*c*-2-34*h*-2, the spool stroke of the non-travel flow control valve 26*c*-26*h*, and the opening area of the non-travel flow control valve 26*c*-26*h* change like the characteristics B1, B2 and B3 shown in FIGS. 3A, 3B and 3C, respectively. Specifically, with the increase in the lever operation amount, the operation pilot pressure increases. However, after the operation pilot pressure has increased to Ppa with the increase in the lever operation amount to an intermediate operation amount Xa, the operation pilot pressure does not increase further and remains constant at Ppa even if the lever operation amount increases further (characteristic B1 shown in FIG. 3A). The operation pilot pressure Ppa is equal to the reduced pilot primary pressure (pressure after the reduction by the pressure reducing valve 47).

As a result, the spool stroke of the non-travel flow control valve 26*c*-26*h* increases from 0 only to an intermediate stroke Str corresponding to the operation pilot pressure Ppa, that is, the maximum stroke of the non-travel flow control valve 26*c*-26*h* is limited to the intermediate stroke Str (characteristic B2 shown in FIG. 3B). The meter-in maximum opening area is also limited to an intermediate opening area Astr corresponding to the intermediate stroke Str (characteristic B3 shown in FIG. 3C). Therefore, when the hydraulic excavator is traveling due to the operator's operation on the control levers 34*a*-1 and 34*b*-1 of the travel operating devices 34*a* and 34*b*, even if any one of the control levers 34*c*-1-34*h*-1 of the non-travel operating devices 34*c*-

34*h* is operated, the meter-in opening area of the non-travel flow control valve 26*c*-26*h* is restricted and the demanded flow rate of the flow control valve 26*c*-26*h* is limited.

(Operation of Basic Configuration)

First, the operation of the basic configuration of the hydraulic drive system according to this embodiment will be explained.

<When all Control Levers are at Neutral Positions>

When the control levers 34*a*-1-34*h*-1 of all the operating devices 34*a*-34*h* are at their neutral positions, all the flow control valves 26*a*-26*h* are at their neutral positions and no hydraulic fluid is supplied to the actuators 5-12. When the flow control valves 26*a*-26*h* are at the neutral positions, the maximum load pressure PLmax detected by the shuttle valves 22*a*-22*g* equals the tank pressure.

The hydraulic fluid delivered from the main pump 2 is supplied to the supply lines 2*a* and 4*a* and increases the pressure in the supply lines 2*a* and 4*a*. The supply line 4*a* is equipped with the unload valve 25. When the pressure in the supply line 2*a* becomes the preset pressure of the spring 25*a* or more higher than the maximum load pressure PLmax (in this case, the tank pressure), the unload valve 25 opens, returns the hydraulic fluid in the supply line 2*a* to the tank, and thereby limits the increase in the pressure in the supply line 2*a*. By the above operation, the delivery pressure of the main pump 2 is controlled to be at a minimum pressure Pmin.

The differential pressure reducing valve 24 is outputting the differential pressure PLS between the delivery pressure Pd of the main pump 2 and the maximum load pressure PLmax (the tank pressure in this case) as the absolute pressure. The LS control valve 35*b* of the LS control unit 35B of the main pump 2 is supplied with the output pressure of the engine revolution speed detection valve 30 and the output pressure of the differential pressure reducing valve 24. When the delivery pressure of the main pump 2 rises and the output pressure of the differential pressure reducing valve 24 exceeds the output pressure of the engine revolution speed detection valve 30, the LS control valve 35*b* is switched to the rightward position in FIG. 1A. In this state, the pressure of the pilot hydraulic pressure source 33 is supplied to the LS control tilting actuator 35*c*, by which the tilting angle of the main pump 2 is reduced. However, since the main pump 2 has a stopper (unshown) that determines the minimum tilting angle of the main pump 2, the main pump 2 is held at the minimum tilting angle qmin determined by the stopper and delivers its minimum flow rate Qmin.

<When Control Lever is Operated>

When the control lever for any driven member (assumed here to be the control lever 34*f*-1 of the operating device 34*f* for the boom) is operated, the flow control valve 26*f* for the boom is switched, the hydraulic fluid is supplied to the boom cylinder 10, and the boom cylinder 10 is driven.

The flow rate through the flow control valve 26*f* is determined by the opening area of the meter-in restrictor of the flow control valve 26*f* and the differential pressure across the meter-in restrictor. The differential pressure across the meter-in restrictor is controlled by the pressure compensating valve 27*f* to be equal to the output pressure of the differential pressure reducing valve 24. Therefore, the flow rate through the flow control valve 26*f* (i.e., driving speed of the boom cylinder 10) is controlled according to the operation amount of the control lever.

Meanwhile, the load pressure of the boom cylinder 10 is detected by the shuttle valves 22*a*-22*g* as the maximum load pressure and is transmitted to the differential pressure reducing valve 24 and the unload valve 25.

When the load pressure of the boom cylinder 10 is lead to the unload valve 25 as the maximum load pressure, the cracking pressure of the unload valve 25 (at which the unload valve 25 starts opening) rises accordingly. When the pressure in the supply line 2*a* transiently becomes the preset pressure of the spring 25*a* or more higher than the maximum load pressure, the unload valve 25 opens and thereby returns the hydraulic fluid in the supply line 4*a* to the tank. By this operation, the pressure in the supply lines 2*a* and 4*a* is prevented from exceeding the maximum load pressure PLmax by the preset pressure of the spring 25*a* or more (i.e., prevented from exceeding the sum of the maximum load pressure PLmax and the preset pressure of the spring 25*a*).

When the boom cylinder 10 starts moving, the pressure in the supply lines 2*a* and 4*a* drops temporarily. At this point, the output pressure of the differential pressure reducing valve 24 drops because the difference between the pressure in the supply line 2*a* and the load pressure of the boom cylinder 10 is outputted as the output pressure of the differential pressure reducing valve 24.

The LS control valve 35*b* of the LS control unit 35B of the main pump 2 is supplied with the output pressure of the engine revolution speed detection valve 30 and the output pressure of the differential pressure reducing valve 24. When the output pressure of the differential pressure reducing valve 24 falls below the output pressure of the engine revolution speed detection valve 30, the LS control valve 35*b* is switched to the leftward position in FIG. 1A. In this state, the LS control tilting actuator 35*c* is connected to the tank T, the hydraulic fluid in the LS control tilting actuator 35*c* is returned to the tank, the tilting angle of the main pump 2 is increased, and the delivery flow rate of the main pump 2 increases. The increase of the delivery flow rate of the main pump 2 continues until the output pressure of the differential pressure reducing valve 24 becomes equal to the output pressure of the engine revolution speed detection valve 30. By the above sequence of operations, the delivery pressure of the main pump 2 (the pressure in the supply lines 2*a* and 4*a*) is controlled to be the output pressure of the engine revolution speed detection valve 30 (target differential pressure) higher than the maximum load pressure PLmax (i.e., to be higher than the maximum load pressure PLmax by the output pressure of the engine revolution speed detection valve 30 (target differential pressure)) and the so-called load sensing control for supplying the flow rate (flow) demanded by the boom flow control valve 26*f* to the boom cylinder 10 is carried out.

When the control levers of operating devices for two or more driven members (assumed here to be the control lever 34*f*-1 of the operating device 34*f* for the boom and the control lever 34*g*-1 of the operating device 34*g* for the arm) are operated, the flow control valves 26*f* and 26*g* are switched and the hydraulic fluid is supplied to the boom cylinder 10 and the arm cylinder 11 to drive the boom cylinder 10 and the arm cylinder 11.

The higher one of the load pressures of the boom cylinder 10 and the arm cylinder 11 is detected by the shuttle valves 22*a*-22*g* as the maximum load pressure PLmax and is transmitted to the differential pressure reducing valve 24 and the unload valve 25.

The operation when the maximum load pressure PLmax detected by the shuttle valves 22*a*-22*g* is lead to the unload valve 25 is equivalent to that in the case where the boom cylinder 10 is driven alone. The cracking pressure of the unload valve 25 rises according to the rise in the maximum load pressure PLmax, and the pressure in the supply lines 2*a* and 4*a* is prevented from exceeding the maximum load pressure PLmax by the preset pressure of the spring 25*a* or more (i.e., prevented from exceeding the sum of the maximum load pressure PLmax and the preset pressure of the spring 25*a*).

The LS control valve 35*b* of the LS control unit 35B of the main pump 2 is supplied with the output pressure of the engine revolution speed detection valve 30 and the output pressure of the differential pressure reducing valve 24. Similarly to the case where the boom cylinder 10 is driven alone, the delivery pressure of the main pump 2 (the pressure in the supply lines 2*a* and 4*a*) is controlled to be the output pressure of the engine revolution speed detection valve 30 (target differential pressure) higher than the maximum load pressure PLmax (i.e., to be higher than the maximum load pressure PLmax by the output pressure of the engine revolution speed detection valve 30 (target differential pressure)) and the so-called load sensing control for supplying the flow rate (flow) demanded by the flow control valves 26*f* and 26*g* to the boom cylinder 10 and the arm cylinder 11 is carried out.

The output pressure of the differential pressure reducing valve 24 is lead to the pressure compensating valves 27*a*-27*h* as the target compensation differential pressure. The pressure compensating valves 27*f* and 27*g* perform control so that the differential pressure across the flow control valve 26*f* and the differential pressure across the flow control valve 26*g* equal the differential pressure between the delivery pressure of the main pump 2 and the maximum load pressure PLmax. This makes it possible to supply the hydraulic fluid to the boom cylinder 10 and the arm cylinder 11 according to the ratio between the opening areas of the meter-in restrictor parts of the flow control valves 26*f* and 26*g* irrespective of the magnitude of the load pressures of the boom cylinder 10 and the arm cylinder 11.

In this case, when the delivery flow rate of the main pump 2 falls below the flow rate demanded by the flow control valves 26*f* and 26*g* (saturation state), the output pressure of the differential pressure reducing valve 24 (the differential pressure between the delivery pressure of the main pump 2 and the maximum load pressure PLmax) drops according to the degree of the saturation. Since the target compensation differential pressure of the pressure compensating valves 27*a*-27*h* also drops accordingly, the delivery flow rate (delivery flow) of the main pump 2 can be redistributed properly at the ratio between the flow rates demanded by the flow control valves 26*f* and 26*g*.

Further, since the pressure compensating valves 27*a*-27*h* are configured not to fully close at the stroke end in the direction of decreasing the opening area (leftward in FIG. 1A), even when the saturation occurs due to the combined operation (operating the boom cylinder 10 or the arm cylinder 11 while operating the other) and the pressure compensating valve on the low load side moves greatly in the direction of decreasing the opening area, the full closure of the pressure compensating valve on the low load pressure side is prevented. Since total interruption of the hydraulic fluid does not occur, the deceleration and stoppage of the actuator on the low load pressure side can be prevented.

<When Engine Revolution Speed is Reduced>

The operation described above is the operation at times when the engine 1 is rotating at its maximum rated revolution speed. When the revolution speed of the engine 1 is reduced to a lower speed, the output pressure of the engine revolution speed detection valve 30 drops correspondingly and thus the target differential pressure of the LS control valve 35*b* of the LS control unit 35B also drops similarly. Further, the target compensation differential pressure of the pressure compensating valves 27*a*-27*h* also drops similarly as a result of the load sensing control. Thus, with the reduction in the engine revolution speed, the delivery flow rate of the main pump 2 and the demanded flow rate of the flow control valves 26*a*-26*h* decrease. Consequently, the driving speeds of the actuators 5-12 are prevented from increasing too much and the fine-tuning operability when the engine revolution speed is reduced can be improved.

(Operation of Characteristic Configuration)

Next, the operation of the characteristic configuration of the hydraulic drive system according to this embodiment will be explained below.

Also when the control levers 34*a*-1 and 34*b*-1 of the travel operating devices 34*a* and 34*b* are operated, the flow control valves 26*a* and 26*b* are switched and the hydraulic fluid is supplied to the travel motors 5 and 6 similarly to the above-described case of combined operation. Meanwhile, the delivery flow rate of the main pump 2 is controlled by the load sensing control, the flow rate (flow) demanded by the flow control valves 26*a* and 26*b* is supplied to the travel motors 5 and 6, and the hydraulic excavator travels.

When the control lever for any one of the boom, the arm and the bucket (assumed here to be the control lever 34*g*-1 of the operating device 34*g* for the arm) is operated during the traveling of the hydraulic excavator in order to change the posture of the front work implement, the flow control valve 26*g* is switched, the hydraulic fluid is supplied also to the arm cylinder 11, and the arm cylinder 11 is driven.

At this point, the travel operation pilot pressure has been generated due to the operator's operation on the control levers 34*a*-1 and 34*b*-1 of the travel operating devices 34*a* and 34*b*, the selector valve 46 has been switched to the second position (leftward in FIG. 1B), and the pilot primary pressure of the pilot hydraulic pressure source 33 has been reduced and lead to the remote control valve 34*g*-2 of the arm operating device 34*g*. Thus, as explained referring to FIGS. 3A, 3B and 3C, the operation pilot pressure generated by the remote control valve 34*g*-2 of the arm operating device 34*g* is limited to the pressure Ppa shown in FIG. 3A, the spool stroke of the flow control valve 26*g* is limited to the stroke Str shown in FIG. 3B, and the meter-in opening area of the flow control valve 26*g* is limited to the intermediate opening area Astr shown in FIG. 3C. Consequently, the demanded flow rate of the flow control valve 26*g* is restricted even when the control lever 34*g*-1 of the arm operating device 34*g* is operated to the limit.

Incidentally, in the conventional configuration in which the pressure compensating valves are of the type in which full closing of the valves is not attained at the stroke end in the direction of decreasing the opening area, when another driven member (e.g., the boom, arm or bucket) is operated during the traveling (especially in a condition in which the travel load pressure tends to rise (e.g., ascending slope)), the pressure compensating valve of the low-load actuator (e.g., the boom cylinder, arm cylinder or bucket cylinder at lower load pressure than the travel motors) is still open even after reaching the stroke end. Thus, there are cases where all the delivery flow rate (delivery flow) of the hydraulic pump flows to the low-load actuator and the traveling of the hydraulic excavator is decelerated or stopped.

In contrast, in this embodiment, even when the control lever 34*g*-1 of the arm operating device 34*g* is operated to the limit, the meter-in opening area of the flow control valve 26*g* is limited to Astr and the demanded flow rate of the flow control valve 26*g* is restricted as explained above. Accordingly, the flow rate of the hydraulic fluid flowing into the low load pressure actuator decreases. Consequently, a necessary amount of hydraulic fluid for the travel motors 5 and 6 is secured, the deceleration/stoppage of the traveling is prevented, and excellent operability in the combined operation is achieved.

Also when the control lever 34*d*-1 of the operating device 34*d* for the blade is operated quickly during the traveling, in the conventional configuration in which the pressure compensating valves are of the type in which full closing of the valves is not attained at the stroke end in the direction of decreasing the opening area, the hydraulic fluid instantaneously flows into the blade cylinder 8 and the traveling of the hydraulic excavator is decelerated or stopped. The deceleration/stoppage of the traveling causes a cenesthesic shock and deteriorates the operational feel. In contrast, in this embodiment, the demanded flow rate of the flow control valve 26*d* for the blade is restricted similarly to the above case where the control lever of the operating device for the boom, arm or bucket is operated during the traveling in order to change the posture of the front work implement. Consequently, the necessary amount of hydraulic fluid for the travel motors 5 and 6 is secured, the deceleration/stoppage of the traveling is prevented, and the operational feel is improved.

(Effect)

As described above, according to this embodiment, when the saturation occurs during combined operation with a great load pressure difference between two actuators, the full closure of the pressure compensating valve on the low load pressure side is prevented, by which the deceleration/stoppage of the actuator on the low load pressure side is prevented. Further, in the travel combined operation including the driving of the travel motors 5 and 6 (specific actuators), the operation pilot pressures of the non-travel actuators are restricted. Consequently, the inflow of the hydraulic fluid into the non-travel actuators is suppressed, the necessary amount of hydraulic fluid for the travel motors is secured, the deceleration/stoppage of the traveling is prevented, and the operability in the travel combined operation is improved.

Second Embodiment

Figure 4:
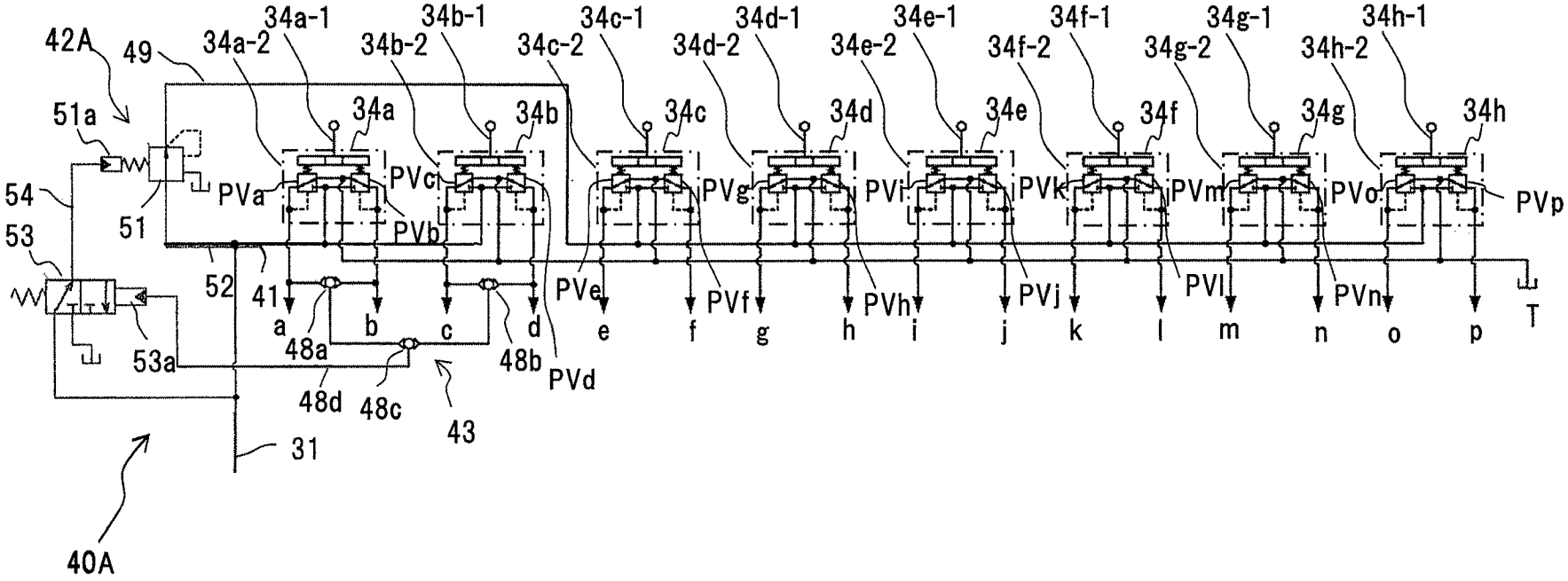
FIG. 4 is an enlarged view showing the operating devices and their pilot circuit in a hydraulic drive system for a hydraulic excavator in accordance with a second embodiment of the present invention.

FIG. 4 shows the operating devices and their pilot circuit in a hydraulic drive system for a hydraulic excavator in accordance with a second embodiment of the present invention. Elements in FIG. 4 equivalent to those shown in FIG. 1B are assigned the same reference characters as in FIG. 1B and repeated explanation thereof is omitted for brevity. This embodiment differs from the first embodiment in the configuration for reducing the pilot primary pressure and the configuration for switching the pilot primary pressure.

Specifically, the hydraulic drive system in this embodiment comprises a pilot primary pressure circuit 40A. A second circuit 42A of the pilot primary pressure circuit 40A includes a fifth circuit 52 and a sixth circuit 54. The fifth circuit 52 has a pilot-operated pressure reducing valve 51. The sixth circuit 54 has a selector valve 53 which switches the pilot pressure lead to a pilot pressure receiving part 51*a* of the pilot-operated pressure reducing valve 51 between the pressure of the pilot hydraulic pressure source 33 (first pressure) and the tank pressure (second pressure). When the pilot pressure lead to the pilot pressure receiving part 51*a* of the pilot-operated pressure reducing valve 51 is the pressure of the pilot hydraulic pressure source 33, the fifth circuit 52 leads the pilot primary pressure directly to the remote control valves 34*c*-2-34*h*-2 of the non-travel operating devices 34*c*-34*h*. When the pilot pressure lead to the pilot pressure receiving part 51*a* of the pilot-operated pressure reducing valve 51 is switched to the tank pressure, the fifth circuit 52 reduces the pilot primary pressure and leads the reduced pilot primary pressure to the remote control valves of the non-travel operating devices.

In this embodiment configured as above, when the control levers 34*a*-1 and 34*b*-1 of the travel operating devices 34*a* and 34*b* are not operated, the pressure of the pilot hydraulic pressure source 33 is lead to the pilot-operated pressure reducing valve 51 via the selector valve 53 and thus the pressure on the outlet side of the pilot-operated pressure reducing valve 51 is not reduced and the pressure of the pilot hydraulic pressure source 33 (pilot primary pressure) is supplied to the remote control valves 34*c*-2-34*h*-2 of the non-travel operating devices 34*c*-34*h*. Consequently, the spool strokes (meter-in opening areas) of the flow control valves 26*c*-26*h* are not restricted and normal operations such as the excavating operation can be carried out.

When the control levers 34*a*-1 and 34*b*-1 of the travel operating devices 34*a* and 34*b* are operated, the travel operation pilot pressure is lead to a pilot pressure receiving part 53*a* of the selector valve 53, the selector valve 53 is switched, and the hydraulic fluid which has been lead to the pilot pressure receiving part 51*a* of the pilot-operated pressure reducing valve 51 is interrupted. Accordingly, the primary pilot pressure which is lead to the remote control valves 34*c*-2-34*h*-2 of the non-travel operating devices is reduced by the pilot-operated pressure reducing valve 51, the spool strokes (meter-in opening areas) of the flow control valves 26*c*-26*h* are restricted, and their demanded flow rate is restricted. Consequently, the necessary amount of hydraulic fluid for the travel motors 5 and 6 is secured, the stoppage of the traveling is prevented, and excellent operability in the combined operation is achieved.

As above, also in this embodiment, effects similar to those of the first embodiment can be achieved.

Third Embodiment

Figure 5:
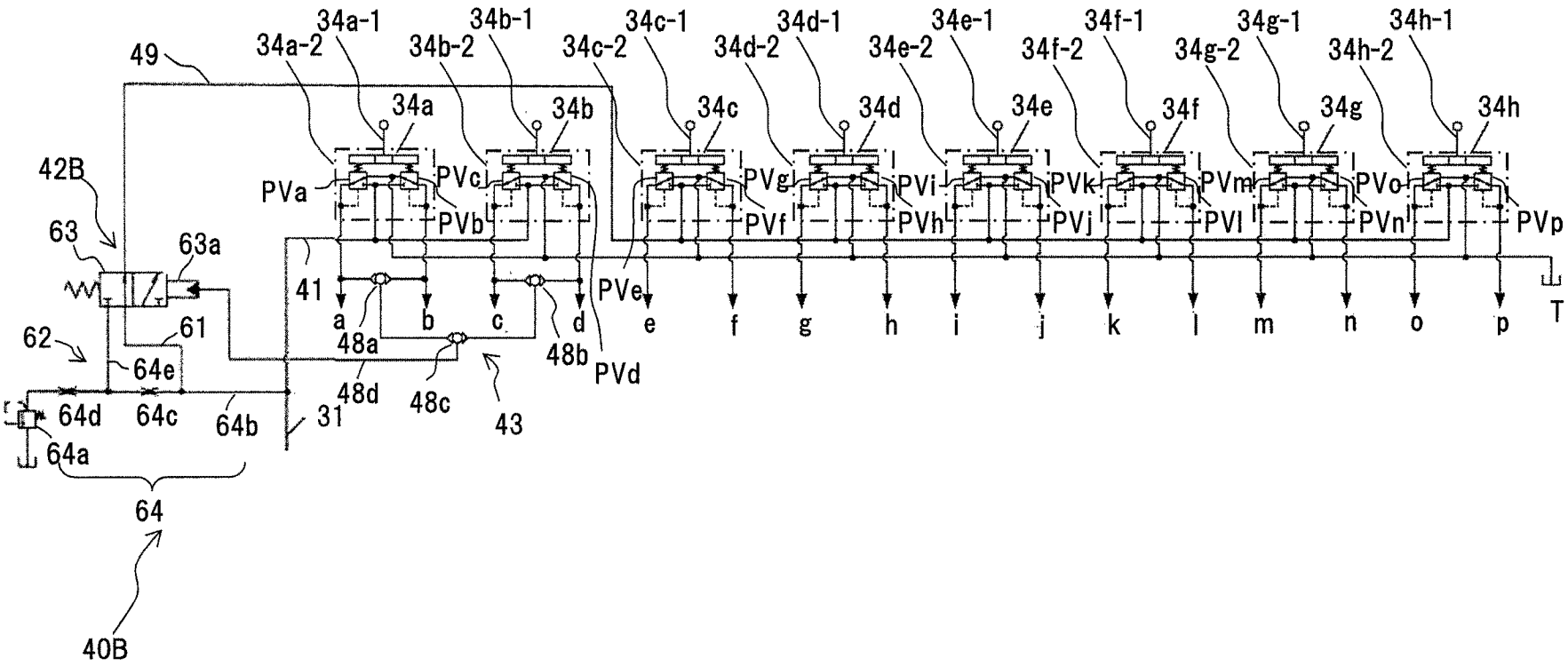
FIG. 5 is an enlarged view showing the operating devices and their pilot circuit in a hydraulic drive system for a hydraulic excavator in accordance with a third embodiment of the present invention.

FIG. 5 shows the operating devices and their pilot circuit in a hydraulic drive system for a hydraulic excavator in accordance with a third embodiment of the present invention. Elements in FIG. 5 equivalent to those shown in FIG. 1B are assigned the same reference characters as in FIG. 1B and repeated explanation thereof is omitted for brevity. This embodiment differs from the first embodiment in the configuration for reducing the pilot primary pressure (fourth circuit).

Specifically, the hydraulic drive system in this embodiment comprises a pilot primary pressure circuit 40B. A second circuit 42B of the pilot primary pressure circuit 40B includes a third circuit 61 for directly supplying the pilot primary pressure, a fourth circuit 62 for reducing the pilot primary pressure and supplying the reduced pilot primary pressure, and a selector valve 63 for making a selection from (switching between) the pressure of the third circuit 61 and the pressure of the fourth circuit 62 and supplying the selected pressure to the remote control valves of the non-travel operating devices. The fourth circuit 62 includes a restrictor circuit 64 for reducing the pilot primary pressure. The restrictor circuit 64 includes a hydraulic line 64*b* whose upstream end is connected to the pilot line 31 and downstream end is connected to the tank T via a low-pressure relief valve 64*a*, two fixed restrictors 64*c* and 64*d* which are arranged in the hydraulic line 64*b*, and a hydraulic line 64*e* which is connected to a point between the two fixed restrictors 64*c* and 64*d*. An intermediate pressure obtained by pressure reduction by the two fixed restrictors 64*c* and 64*d* is lead to the hydraulic line 64*e*.

The pressure of the pilot hydraulic pressure source 33 (pilot primary pressure) is maintained by the fixed restrictor 64*c* at a normal pressure which is set by the pilot relief valve 32 (see FIG. 1A). When the control levers 34*a*-1 and 34*b*-1 of the travel operating devices 34*a* and 34*b* are not operated, the pressure of the pilot hydraulic pressure source 33 (pilot primary pressure) is lead to the remote control valves 34*c*-2-34*h*-2 of the non-travel operating devices 34*c*-34*h* via the selector valve 63. Therefore, the spool strokes (meter-in opening areas) of the flow control valves 26*c*-26*h* are not restricted and normal operations such as the excavating operation can be carried out.

When the control levers 34*a*-1 and 34*b*-1 of the travel operating devices 34*a* and 34*b* are operated, the travel operation pilot pressure is lead to a pilot pressure receiving part 63*a* of the selector valve 63, the selector valve 63 is switched, and the pressure reduced by the fixed restrictors 64*c* and 64*d* of the restrictor circuit 64 is lead to the remote control valves 34*c*-2-34*h*-2 of the non-travel operating devices. Accordingly, the spool strokes (meter-in opening areas) of the flow control valves 26*c*-26*h* are limited and their demanded flow rate is restricted. Consequently, the necessary amount of hydraulic fluid for the travel motors 5 and 6 is secured, the stoppage of the traveling is prevented, and excellent operability in the combined operation is achieved.

As above, also in this embodiment, effects similar to those of the first embodiment can be achieved.

Fourth Embodiment

Figure 6:
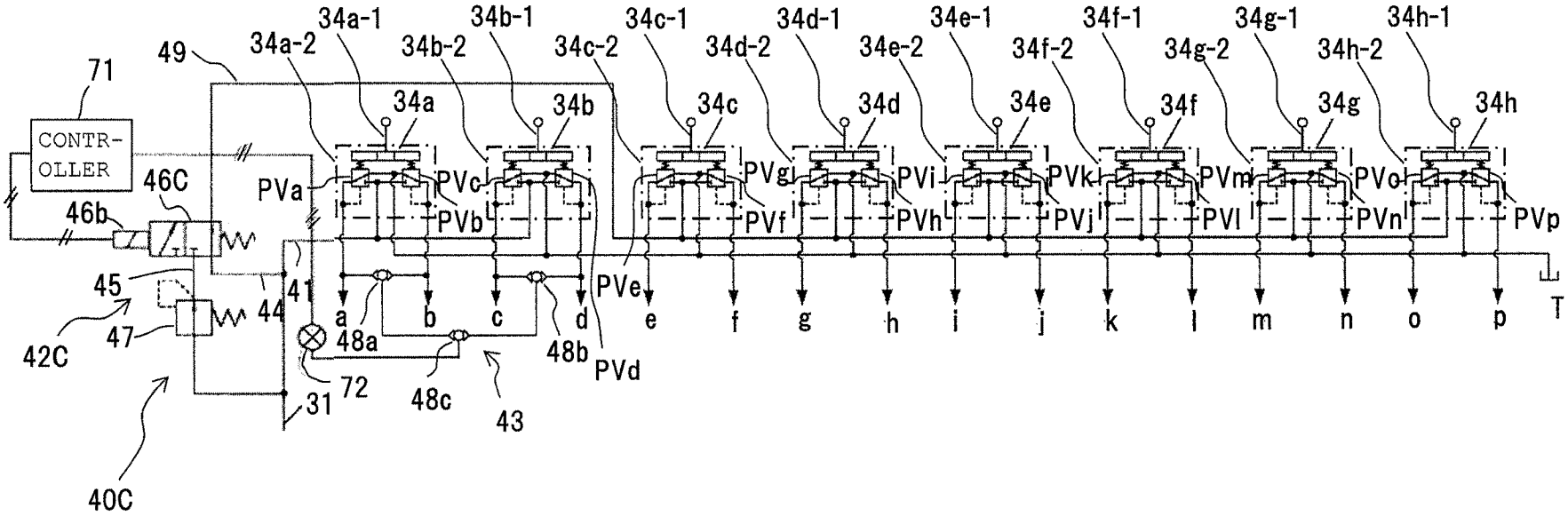
FIG. 6 is an enlarged view showing the operating devices and their pilot circuit in a hydraulic drive system for a hydraulic excavator in accordance with a fourth embodiment of the present invention.

FIG. 6 shows the operating devices and their pilot circuit in a hydraulic drive system for a hydraulic excavator in accordance with a fourth embodiment of the present invention. Elements in FIG. 6 equivalent to those shown in FIG. 1B are assigned the same reference characters as in FIG. 1B and repeated explanation thereof is omitted for brevity. This embodiment differs from the first embodiment in the configuration for the switching between the third circuit and the fourth circuit.

Specifically, the hydraulic drive system in this embodiment comprises a pilot primary pressure circuit 40C. A second circuit 42C of the pilot primary pressure circuit 40C includes a solenoid selector valve 46C and a controller 71 instead of the hydraulic selector valve 46 in the first embodiment. An operation detection device 43C includes a pressure sensor 72 which outputs an electric signal by detecting the operation pilot pressures generated by the remote control valves of the travel operating devices (included in the plurality of operating devices). The electric signal from the pressure sensor 72 is inputted to the controller 71. The controller 71 converts the electric signal into a drive signal for the solenoid selector valve 46C and outputs the drive signal to a solenoid 46*b* of the solenoid selector valve 46C.

When the control levers 34*a*-1 and 34*b*-1 of the travel operating devices (specific operating devices) 34*a* and 34*b* are not operated and no drive signal is outputted from the controller 71, the solenoid selector valve 46C is situated at a first position (rightward in FIG. 6), the third circuit 44 is connected to the circuit 49 reaching the remote control valves 34*c*-2-34*h*-2 of the non-travel operating devices 34*c*-34*h*, and the pilot primary pressure is directly supplied to the remote control valves 34*c*-2-34*h*-2 of the non-travel operating devices 34*c*-34*h*. When the control levers 34*a*-1 and 34*b*-1 of the travel operating devices 34*a* and 34*b* are operated and the drive signal is outputted from the controller 71, the solenoid selector valve 46C is activated and switched to a second position (leftward in FIG. 6), the fourth circuit 45 is connected to the circuit 49 reaching the remote control valves 34*c*-2-34*h*-2 of the non-travel operating devices 34*c*-34*h*, the pilot primary pressure is reduced by the pressure reducing valve 47, and the reduced pilot primary pressure is supplied to the remote control valves 34*c*-2-34*h*-2 of the non-travel operating devices 34*c*-34*h*.

As above, also in this embodiment, effects similar to those of the first embodiment can be achieved.

Incidentally, while this embodiment employs a solenoid selector valve instead of the selector valve 46 shown in FIG. 1B, it is also possible to employ a solenoid selector valve instead of the selector valve 53 shown in FIG. 4 or the selector valve 63 shown in FIG. 5, provide a pressure sensor and a controller similarly to this embodiment, and have the solenoid selector valve switched by the electric signal from the controller.

Fifth Embodiment

Figure 7:
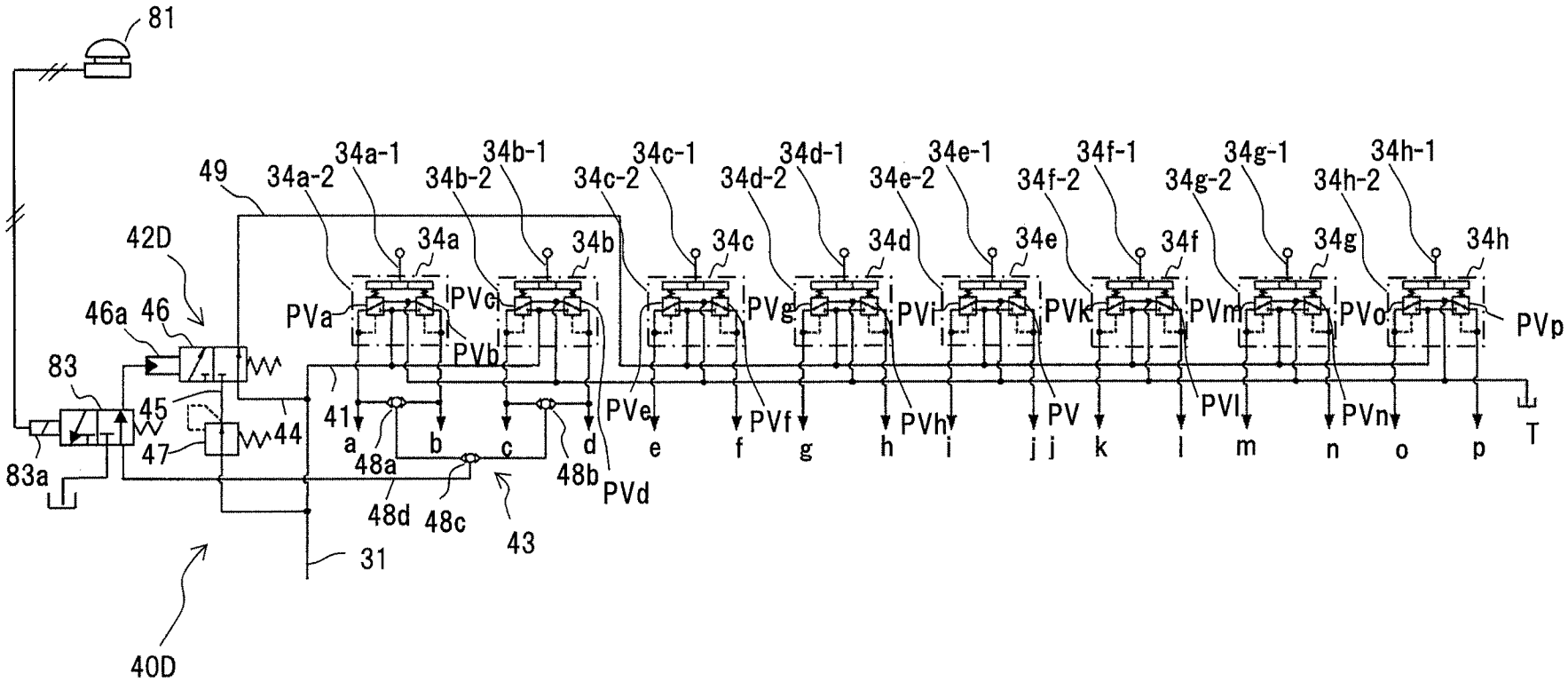
FIG. 7 is an enlarged view showing the operating devices and their pilot circuit in a hydraulic drive system for a hydraulic excavator in accordance with a fifth embodiment of the present invention.

FIG. 7 shows the operating devices and their pilot circuit in a hydraulic drive system for a hydraulic excavator in accordance with a fifth embodiment of the present invention. Elements in FIG. 7 equivalent to those shown in FIG. 1B are assigned the same reference characters as in FIG. 1B and repeated explanation thereof is omitted for brevity. This embodiment differs from the first embodiment in the configuration for switching the selector valve of the second circuit.

Specifically, the hydraulic drive system in this embodiment further comprises a manual selection device 81 which can be switched between a first position and a second position. The manual selection device 81 is implemented by, for example, a switch that outputs an electric signal corresponding to the switch position. Further, a second circuit 42D of a pilot primary pressure circuit 40D in this embodiment further includes a solenoid selector valve 83 which is arranged in the hydraulic line 48*d* (leading the hydraulic signal detected by the operation detection device 43 to the pilot pressure receiving part 46*a* of the selector valve 46) and operates according to the electric signal from the manual selection device (manual switch) 81.

When the manual selection device 81 is at the first position and no electric signal is outputted therefrom, the solenoid selector valve 83 is situated at a first position (rightward in FIG. 7) and allows the hydraulic signal detected by the operation detection device 43 to be supplied to the selector valve 46. When the manual selection device 81 is switched to the second position and an electric signal is outputted to a solenoid 83*a* of the solenoid selector valve 83, the solenoid selector valve 83 is switched to a second position (leftward in FIG. 7) and blocks the hydraulic signal detected by the operation detection device 43 from being supplied to the selector valve 46. Consequently, when the manual selection device 81 is at the first position, the function of reducing the pilot primary pressure when the control levers 34*a*-1 and 34*b*-1 of the travel operating devices (specific operating devices) 34*a* and 34*b* are operated is made active (enabled), and similarly to the above-described embodiments, the operation pilot pressure for the non-travel actuators is reduced at the times of the travel combined operation and the control for restricting the demanded flow rate can be carried out. In contrast, when the manual selection device 81 is switched to the second position, the function of reducing the pilot primary pressure when the control levers 34*a*-1 and 34*b*-1 of the travel operating devices (specific operating devices) 34*a* and 34*b* are operated is made inactive (disabled). In this case, even in the travel combined operation, the operation pilot pressure for the non-travel actuators is not reduced and the maximum strokes of the flow control valves 26*c*-26*h* are not limited, by which the conventional operation is made possible.

In this embodiment configured as above, the operator is allowed to freely select whether to use the control for restricting the demanded flow rate for the non-travel actuators according to the present invention or not based on the operator's preference or the type of the work/operation.

Other Examples

The embodiments described above can be modified in various ways within the spirit and scope of the present invention. For example, while a case where the specific actuators are the travel motors has been described in the above embodiments, equivalent effects can be achieved by the present invention even in cases where the specific actuators are actuators other than the travel motors as long as the hydraulic drive system comprises pressure compensating valves of the type in which full closing of the valves is not attained at the stroke end in the direction of decreasing the opening area and the specific actuators are actuators that can stop (due to the consumption of most of the delivery flow rate of the main pump by other actuators on the low load pressure side) when the saturation is caused by combined operation with a great load pressure difference. For example, the load pressure of the reserve actuator for an attachment like the crusher tends to rise to a high level. By employing the present invention while designating the reserve actuator as the specific actuator, it is possible to restrict the demanded flow rate for the other actuators and preferentially supply the hydraulic fluid to the reserve actuator at the times of combined operation with other actuators (boom, arm, bucket, etc.).

While the above embodiments have been described by taking a hydraulic excavator as an example of the construction machine, it is also possible to apply the present invention to other types of construction machines (hydraulic cranes, wheel excavators, etc.) and achieve equivalent effects.

DESCRIPTION OF REFERENCE CHARACTERS

1 engine
2 hydraulic pump (main pump)
2*a* supply line
3 pilot pump
3*a* supply line
4 control valve
4*a* in-valve supply line
5-12 actuator
5, 6 travel motor
7 swing motor
8 blade cylinder
9 swing cylinder
10 boom cylinder
11 arm cylinder
12 bucket cylinder
13-20 valve section
21 signal hydraulic line
22*a*-22*g* shuttle valve
23 main relief valve
24 differential pressure reducing valve
25 unload valve
25*a* spring
26*a*-26*h* flow control valve
27*a*-27*h* pressure compensating valve
29 in-valve tank line
30 engine revolution speed detection valve device
30*a* flow rate detection valve
30*b* differential pressure reducing valve
30*c* variable restrictor part
30*f* fixed restrictor part
31 pilot line
32 pilot relief valve
33 pilot hydraulic pressure source
34*a*-34*h* operating device
34*a*-1-34*h*-1 control lever
34*a*-2-34*h*-2 remote control valve
35 pump control system
35A pump torque control unit
35B LS control unit
35*a* torque control tilting actuator
35*b* LS control valve
35*c* LS control tilting actuator
35*d*, 35*e* pressure receiving part
40, 40A, 40B, 40C, 40D pilot primary pressure circuit
41 first circuit
42, 42A, 42B, 42C, 42D second circuit
43, 43C operation detection device
44 third circuit
45 fourth circuit
46 selector valve
46C solenoid selector valve
47 pressure reducing valve
48*a*, 48*b*, 48*c* shuttle valve
48*d* hydraulic line
51 pilot-operated pressure reducing valve
52 fifth circuit
53 selector valve
61 third circuit
62 fourth circuit
63 selector valve
64 restrictor circuit
64*a* low-pressure relief valve
64*b* hydraulic line
64*c*, 64*d* fixed restrictor
64*e* hydraulic line
71 controller
72 pressure sensor
81 manual selection device (manual switch)
83 solenoid selector valve
300 upper swing structure
301 lower track structure
302 front work implement
303 swing post
304 center frame
305 blade
306 boom
307 arm
308 bucket
310, 311 crawler

The invention claimed is:

1. A hydraulic drive system for a construction machine, comprising:

a variable displacement type hydraulic pump;

a plurality of actuators which are driven by hydraulic fluid delivered from the hydraulic pump;

a plurality of flow control valves which respectively control flow rates of the hydraulic fluid supplied from the hydraulic pump to the actuators;

a plurality of operating devices corresponding respectively to the actuators, each of the operating devices includes a remote control valve for generating operation pilot pressures for driving the corresponding flow control valve;

a plurality of pressure compensating valves which are connected to a supply line of the hydraulic pump and which respectively control differential pressures across the flow control valves;

a pilot primary pressure circuit which supplies, as pilot primary pressure, a pressure of a pilot hydraulic pressure source to the remote control valves of the operating devices; and a pump control system which performs load sensing control of a displacement of the hydraulic pump, wherein the plurality of actuators include a travel motor for moving a track structure, a swing motor for driving a swing structure, and a boom cylinder, an arm cylinder and a bucket cylinder for driving a front work implement;

wherein the plurality of operating devices include travel motor operating device for the travel motor, and operating devices other than the travel motor operating device, which include a swing motor operating device for the swing motor, a boom cylinder operating device for the boom cylinder, an arm cylinder operating device for the arm cylinder and a bucket cylinder operating device for the bucket cylinder;

wherein the pressure compensating valves are of the type in which full closing of the valves is not attained at a stroke end in a direction of decreasing an opening area;

wherein the travel motor is such an actuator that during a combined operation with the other actuators, the load pressure of the travel motor can be increased to such an extent that the pressure compensating valves for the other actuators reach a stroke end;

wherein the pilot primary pressure circuit includes:

a first circuit which supplies the pilot primary pressure to the remote control valve of the travel motor operating device, and a second circuit which supplies the pilot primary pressure to the plural remote control valves of the swing motor operating device, the boom cylinder operating device, the arm cylinder operating device and the bucket cylinder operating device, and wherein the second circuit includes a selector valve which is switched in accordance with an operation of the travel motor operating device to control the pilot primary pressure supplied to the plural remote control valves of the second circuit, the selector valve being configured such that when the travel motor operating device is not operated, the selector valve is switched in a position in which the pilot primary pressure is supplied directly to the plural remote control valves of the second circuit and when the travel motor operating device is operated, the selector valve is switched in a position in which the pilot primary pressure is reduced and the reduced pilot primary pressure is supplied to the plural remote control valves of the second circuit.

2. The hydraulic drive system for a construction machine according to claim 1, wherein the second circuit includes: a third circuit which directly supplies the pilot primary pressure to the plural remote control valves of the second circuit; a fourth circuit which reduces the pilot primary pressure and supplies the reduced pilot primary pressure to the plural remote control valves of the second circuit; and wherein when the travel motor operating device is not operated, the selector valve is switched in a position in which the pilot primary pressure in the third circuit is supplied to the plural remote control valves of the second circuit and when the travel motor operating device is operated, the selector valve is switched in a position in which the pilot primary pressure in the fourth circuit is supplied to the plural remote control valves of the second circuit.

3. The hydraulic drive system for a construction machine according to claim 2, wherein the fourth circuit includes a pressure reducing valve which reduces the pilot primary pressure.

4. The hydraulic drive system for a construction machine according to claim 1, wherein the second circuit includes: a pilot-operated pressure reducing valve and a circuit configured to supply the pilot primary pressure directly to the plural remote control valves of the second circuit when pilot pressure supplied to the pilot-operated pressure reducing valve is at a first pressure, and to reduce the pilot primary pressure and supply the reduced pilot primary pressure to the plural remote control valves of the second circuit when the pilot pressure supplied to the pilot-operated pressure reducing valve is switched to a second pressure; and wherein the selector valve is disposed in a circuit in which the pilot pressure is supplied to the pilot-operated pressure reducing valve and the selector valve switches the pilot pressure supplied to the pilot-operated pressure reducing valve between the first pressure and the second pressure.

5. The hydraulic drive system for a construction machine according to claim 1, further comprising an operation detection device which detects operation of the travel motor operating device, wherein when the operation detection device detects no operation of the travel motor operating device, the selector valve is switched to a position in which the pilot primary pressure is supplied directly to the plural remote control valves of the second circuit, and when the operation detection device detects the operation of the travel motor operating device, the selector valve is switched in a position in which the pilot primary pressure is reduced and the reduced pilot primary pressure is supplied to the plural remote control valves of the second circuit.

6. The hydraulic drive system for a construction machine according to claim 2, further comprising a shuttle valve which detects the operation pilot pressure generated by the remote control valve of the first circuit and output the detected operation pilot pressure as a hydraulic signal, wherein the selector valve is a hydraulic selector valve which is switched by the hydraulic signal.

7. The hydraulic drive system for a construction machine according to claim 2, further comprising a pressure sensor which outputs an electric signal by detecting the operation pilot pressure generated by the remote control valve of the first circuit, wherein the selector valve is a solenoid selector valve which operates according to the electric signal.

* * * * *